US006047884A

United States Patent [19]

Smith et al.

[11] Patent Number: 6,047,884

[45] Date of Patent: Apr. 11, 2000

[54] BOXES WITH ANGLED INNER PANELS

[75] Inventors: Jeffrey A. Smith, Clark; Richard N. Beneroff, Chatham; Eric Kim, Secaucus, all of N.J.

[73] Assignee: Motion Design, Inc., Linden, N.J.

[21] Appl. No.: 09/160,217

[22] Filed: Sep. 24, 1998

Related U.S. Application Data

[63] Continuation-in-part of application No. 08/896,775, Jul. 18, 1997, Pat. No. 5,871,147, and a continuation-in-part of application No. 08/987,112, Dec. 8, 1997, Pat. No. 5,857,612.

[51] Int. Cl.[7] ..... B65D 5/28

[52] U.S. Cl. ..... 229/168; 206/485; 206/564; 229/120.12; 229/120.17; 229/167

[58] Field of Search ..... 229/127, 142, 229/152, 153, 185.1, 120.12, 120.17, 167, 168; 206/485, 564, 587, 591

[56] References Cited

U.S. PATENT DOCUMENTS

| | | | |
|---|---|---|---|
| 363,467 | 5/1987 | Jaccard . | |
| 2,321,145 | 6/1943 | Jones | 229/167 X |
| 2,325,756 | 8/1943 | Eggebrecht et al. . | |
| 2,450,941 | 10/1948 | Crane | 229/120.04 |
| 2,614,746 | 10/1952 | Frankenstein | 229/167 |
| 2,620,116 | 12/1952 | McDonough . | |
| 2,693,309 | 11/1954 | Giroux et al. | 229/120.04 |
| 2,808,977 | 10/1957 | McCormick . | |
| 2,939,622 | 6/1960 | D'Ippolito | 206/485 |
| 3,002,672 | 10/1961 | Kotowick | 229/167 X |
| 3,347,445 | 10/1967 | Wood . | |
| 3,401,865 | 9/1968 | Holstrom . | |
| 3,680,687 | 8/1972 | D'Alessio . | |
| 3,764,004 | 10/1973 | Forbes, Jr. | 206/45.14 |
| 3,937,320 | 2/1976 | Chao et al. . | |
| 3,968,923 | 7/1976 | Bell et al. | 229/167 |
| 4,187,976 | 2/1980 | Mather . | |
| 4,193,648 | 5/1980 | Gargiulo . | |
| 4,236,662 | 12/1980 | Roccaforte . | |
| 4,294,397 | 10/1981 | Kohler . | |
| 4,324,357 | 4/1982 | Murkowski . | |
| 4,341,339 | 7/1982 | Zore | 229/167 X |
| 4,388,999 | 6/1983 | Berry et al. . | |
| 4,396,145 | 8/1983 | Ditton | 229/120.04 X |
| 4,438,848 | 3/1984 | Montealegre et al. | 206/588 |
| 5,029,709 | 7/1991 | Faulstick | 229/167 X |
| 5,119,932 | 6/1992 | Semanoff . | |
| 5,121,838 | 6/1992 | Dickie | 206/334 |
| 5,130,696 | 7/1992 | Liebman . | |
| 5,145,070 | 9/1992 | Pallett et al. | 206/521 |
| 5,240,176 | 8/1993 | Akers | 229/155 |
| 5,372,259 | 12/1994 | Suzuki et al. | 206/586 |
| 5,540,330 | 7/1996 | Lo Duca | 206/446 |
| 5,715,994 | 2/1998 | Beneroff et al. | 229/167 |
| 5,769,309 | 6/1998 | Beneroff et al. | 229/167 |
| 5,823,352 | 10/1998 | Mena et al. | 206/721 |
| 5,857,612 | 1/1999 | Smith et al. | 229/167 |
| 5,871,147 | 2/1999 | Smith et al. | 229/167 |

FOREIGN PATENT DOCUMENTS

WO 90/06264 6/1990 WIPO .

*Primary Examiner*—Gary E. Elkins
*Attorney, Agent, or Firm*—Kenyon & Kenyon

[57] ABSTRACT

A box with a side panels and at least one closing panel has at least one inner panel associated with one of the closing panels, wherein when the closing panel is in its open position, the inner panel is substantially parallel to that closing panel, and when that closing panel is folded to its closed position, the inner panel is moved toward the center of the box to a distanced position. When the inner panel is in the distanced position, at least a portion of the inner panel is at an oblique angle with respect to both the closing panel with which it is associated and the outer side panel to which that closing panel is connected.

10 Claims, 23 Drawing Sheets

— GLUE PATTERN
XXX FIRST FOLD
OOO SECOND FOLD
ZZZ THIRD FOLD

BOXES WITH ANGLED INNER PANELS

RELATED APPLICATIONS

This application is a continuation-in-part of U.S. patent application Ser. No. 08/896,775, filed Jul. 18, 1997, now U.S. Pat. No. 5,871,147 issued Feb. 16, 1999, and a continuation-in-part of U.S. patent application Ser. No. 08/987,112, filed Dec. 8, 1997 now U.S. Pat. No. 5,857,612 isued Jan. 12, 1999. The disclosures of those two applications are hereby expressly incorporated by reference herein.

BACKGROUND OF THE INVENTION

The invention relates to packaging boxes for the shipping of items or goods in a protective manner. A variety of mechanisms are presently known for specially equipping packaging boxes for shipping items or goods in a protective manner. For instance, blocks or specially molded formations of foamed polyurethane are often inserted into boxes to hold sensitive items, such as electronic equipment, at a distance from the outer panels forming the box to suppress the transmission to the items of any impacts, shocks, vibrations and/or other forces to which the box itself may be subjected. Protecting items in this manner contributes to the cost of the packaging material and operation.

Various other techniques have been used to achieve similar protection in a less expensive way, such as using cardboard inserts to keep the items at a distance from the box panels, foamed polyurethane pellets or beads, or the so-called bubble-wrap sheets. All of these approaches, however, have certain drawbacks, be it their cost, the inadequacy of their supporting or cushioning action, or the failure by packing personnel to find or use the appropriate protective materials.

SUMMARY OF THE INVENTION

A general object of the invention is to provide improved protection for contents of a packaging box, with a relatively simple construction that is inexpensive to manufacture and easy to use.

In accordance with one aspect of the invention, a packaging box is provided with inner panels as integral parts of the box. In the erected condition of the box, the inner panels are distanced from the outer panels, so that the inner panels keep the items in the box at a distance from the outer panels, thereby protecting the items from impacts, shocks, vibrations and/or other forces to which the box may be subjected.

The inner panels may be constructed such that they do not require any special handling in order to put them into place. The moving of the top and/or bottom panels of the box into their closed positions automatically moves the respective inner panels toward the center of the box to their distanced positions in which they are then displaced from their respective adjacent outer panels in order to protect the items being shipped.

The box, with its integral inner panels, may be constructed from a single flat sheet of material, properly cut, folded, and fastened (e.g., glued or stapled). Once the sheet is cut, folded, and fastened, it can lie substantially flat in a pre-erected condition, to facilitate shipping of the box prior to use. That is, for example, after the sheet is cut, folded, and fastened, the box can lie substantially flat by keeping the top and bottom panels in their open positions, parallel to their respective side panels, and by appropriately folding the side panels. The inner panels and any distancing flaps may be constructed so that when the top and bottom panels are in their open positions, parallel to their respective side panels, the inner panels and distancing flaps are also oriented parallel to their adjacent side panels, and thus are also oriented parallel to their adjacent top or bottom panels. In this manner, the distancing flaps and inner panels can lie flat against the side panels and/or top or bottom panels, allowing the box to be collapsed flat without the need for any ungluing or unstapling.

Once the substantially flat box has reached the location at which the goods or items are to be placed in it, the box can be readily and simply erected. For example, in accordance with some embodiments of the invention, the box can be erected by simply "squaring-up" the sides of the box, e.g., by pivoting the sides of the box so that they bound a rectangular (or other) internal space, and then, if necessary, moving the top and bottom panels into their closed positions (in some embodiments the top and/or bottom panels may automatically move into their closed positions by the "squaring-up" of the side panels), so that the erected box forms a parallelepiped or other suitable shape. The movement of the top and/or bottom panels into their closed positions automatically moves the inner panels into their distanced positions in the inside of the box, in which they are then displaced from their respective adjacent outer panels so that they can provide cushioning and protection for an item or items being shipped.

The box may be constructed such that, after the box has been erected, it can be collapsed flat again by simply folding the panels in the appropriate manner, in what is basically the reverse of the operation used to erect the box. Thus, for example, after goods have been shipped in the box, the box can be collapsed flat by moving the top and bottom panels to their open positions and collapsing the side panels in the reverse of the "squaring-up" operation. Thus, the box can be re-shipped flat and then re-used. It can be repeatably and easily erected again and collapsed flat again, without the need to unfasten any of the fastened panels from each other.

In some embodiments of the invention, the outer panels of the box generally form a parellelepiped construction, and the inner panels are at angles with respect to the outer panels. Each of the inner panels may have one section or more than one section with the multiple sections separated by one or more bend lines.

DETAILED DESCRIPTION OF THE ILLUSTRATED EMBODIMENTS

Figure 1:
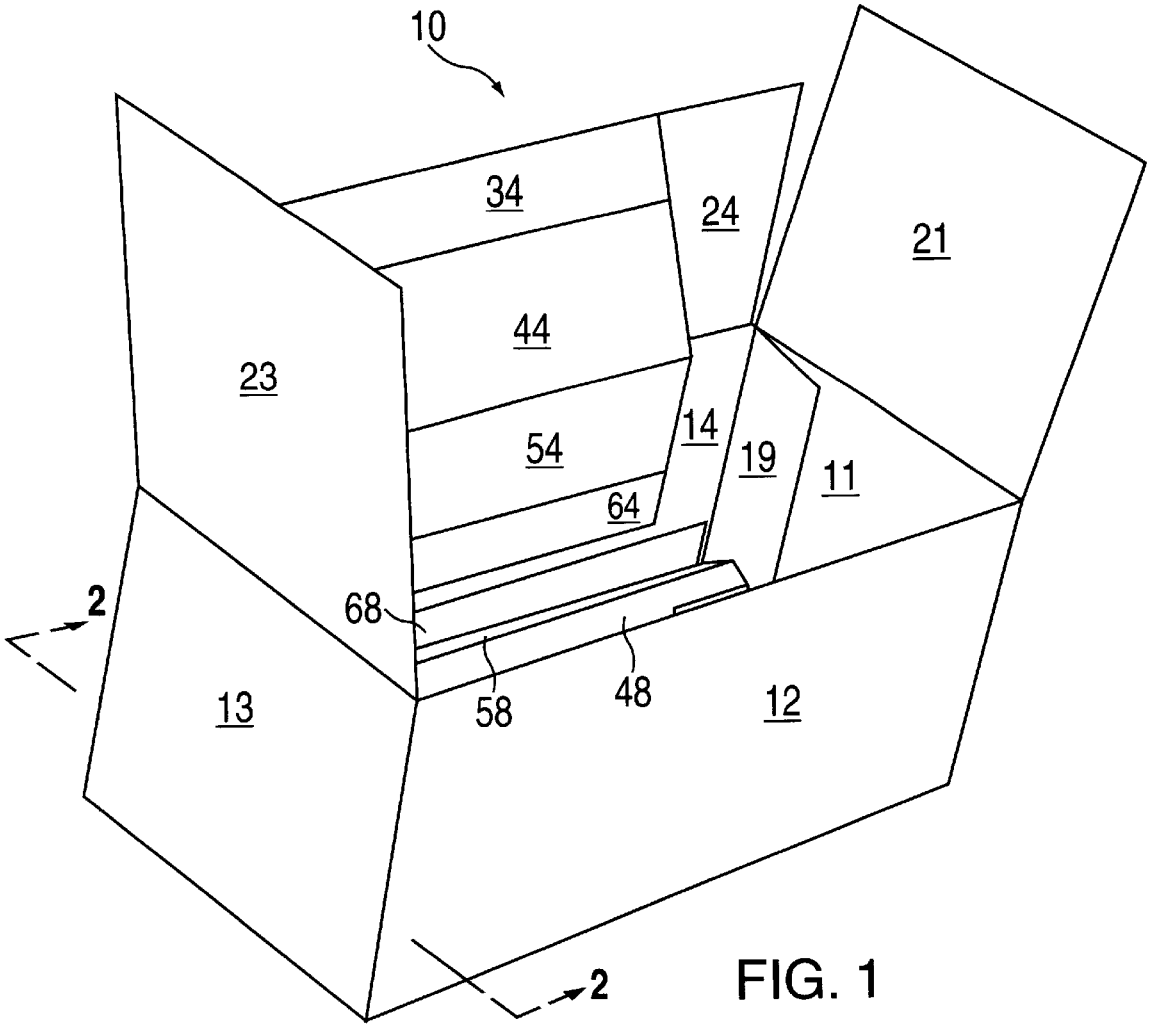
FIG. 1 is a perspective view of a packaging box provided with an angled inner panel construction according to the present invention, with its top panels open.

FIGS. 1 through 4 show a box 10 having a plurality of outer side panels 11 to 14, top panels 21 to 24 (top panel 22 is not shown in FIG. 1 in order to reveal the inside of the box), and bottom panels 25 to 28. This illustrated example has four top panels 21 to 24 and four bottom panels 25 to 28, although more or less top and/or bottom panels may be used. Alternative constructions of top and/or bottom panels may be used, such as, for example, top and/or bottom panels that interlock and/or have flaps that tuck toward the inside of the box. A connecting flap 19 integral with the outer side panel 14 overlaps and is joined (e.g., is glued or stapled) to the outer side panel 11.

The box 10 of FIGS. 1 through 4 is provided with a plurality of inner panels 42, 44, 46, 48 that, in an erected condition of the box 10, extend on the inside of the box, i.e., on the inside of the space bounded by the outer side panels 11 to 14 and the top and bottom panels 21 to 28. When goods or items are placed in the box 10, they are positioned in the internal space bounded by these inner panels 42, 44, 46, 48, and may be braced against these inner panels 42, 44, 46, 48, so that they are thereby spaced from the outer panels of the box. Because of the support provided by the inner panels 42, 44, 46, 48, the goods or items in the box are protected from the effects of vibrations, shocks and impacts to which the box 10 may be subjected as it is being transported, as well as from objects that penetrate and/or damage one or more of the outer panels but stop short of reaching or piercing any of the inner panels. Thus, the goods or items may be suitably protected by the inner panel construction, without the need for additional protective or cushioning measures.

The positioning and lengths of the inner panels may be adjusted as desired for a particular purpose. In this illustrated embodiment, the inner panels 42, 44, 46, 48 are positioned by the use of distancing flaps 32, 34, 52, 54, 56, 58. Each distancing flap 32, 34, 52, 54, 56, 58 is integrally connected to an edge of an inner panel 42, 44, 46, 48 and extends between that inner panel and a respective side panel 12 or 14 or, in the case of distancing flaps 32 and 34, a respective top panel 22 or 24. In the case of distancing flaps 52, 54, 56, 58, the distancing flap is integral with a connecting flap 62, 64, 66, 68, and the connecting flap 62, 64, 66, 68 is, in turn, joined to the respective outer side panel 12 or 14. In the case of distancing flaps 32 and 34, the distancing flap is integral with the respective top panel 22 or 24.

In the illustrated embodiment, the connecting flaps 62, 64, 66, 68 are glued, by glue strips 99, to the adjacent side panel 12 or 14. It will be appreciated that any and all of the connecting flaps 62, 64, 66, 68 may be folded in a direction opposite to that illustrated, so as to have its opposite side surface joined to the associated side panel 12 or 14. In some instances, it may not be necessary to join the connecting flaps permanently to the respective outer side panel.

Figure 5:
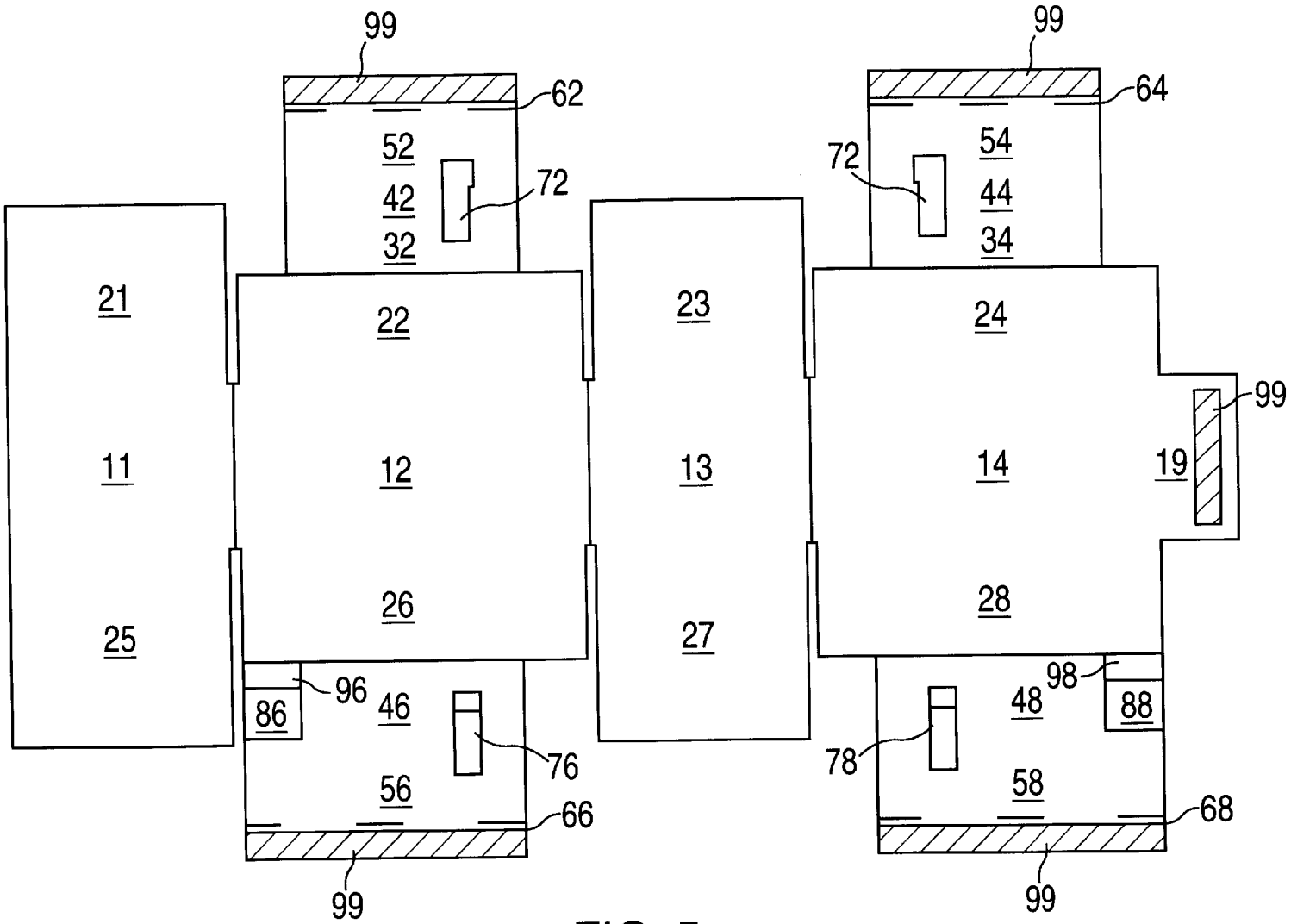
FIG. 5 shows a sheet from which the packaging box of FIGS. 1 through 4 can be formed by folding and connecting the respective associated portions thereof.

As shown in FIG. 5, the outer side panels 11 to 14, the top and bottom panels 21 to 28, the inner panels 42, 44, 46, 48, the distancing flaps 32, 34, 52, 54, 56, 58, and the connecting flaps 19, 62, 64, 66, 68 all are integral parts of a single sheet, which may be a sheet of any suitable material for forming the box 10, such as corrugated cardboard. It should be noted that in FIG. 5, the glue strip 99 on the connecting flap 19 is shown on the inside surface of the connecting flap 19, in which case it will be attached to the outside of the side panel 11 instead of to the inside of the side panel 11 as shown in FIG. 1.

It will be appreciated by persons skilled in the art that once the sheet is cut, folded, and fastened at glue strips 99, it can lie substantially flat in a pre-erected condition, to facilitate shipping of the box prior to use. That is, after the sheet is cut, folded, and fastened, each of the top panels 21 to 24 and each of the bottom panels 25 to 28 may be oriented in an open position, with each lying in substantially the same plane as its respective side panel 11 to 14. With the top and bottom panels so positioned, the inner panels and any distancing flaps are similarly oriented parallel to their adjacent outer side panels and top or bottom panels, such that the distancing flaps and inner panels lie flat against those adjacent panels. The outer side panels 11 to 14 may be collapsed by, for example, folding them with respect to each other along only two fold lines, e.g., along the fold line between side panels 11 and 12 and along the fold line between side panels 13 and 14, such that one pair of side panels, e.g., side panels 12 and 13, lies on top of the other pair of side panels, e.g., side panels 11 and 14. Because each of the respective top panels, bottom panels, inner panels, distancing flaps, and connecting flaps has been oriented parallel to its respective side panel, the box can be collapsed flat, without the need for any ungluing or unstapling.

Figure 2:
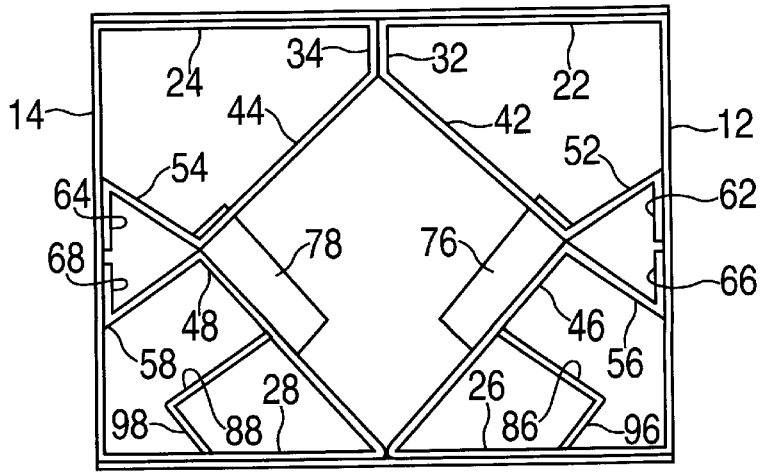
FIG. 2 is cross-sectional view taken through the packaging box of FIG. 1 in the plane indicated by and in the direction of the arrows 2—2 in FIG. 1.
Figure 3:
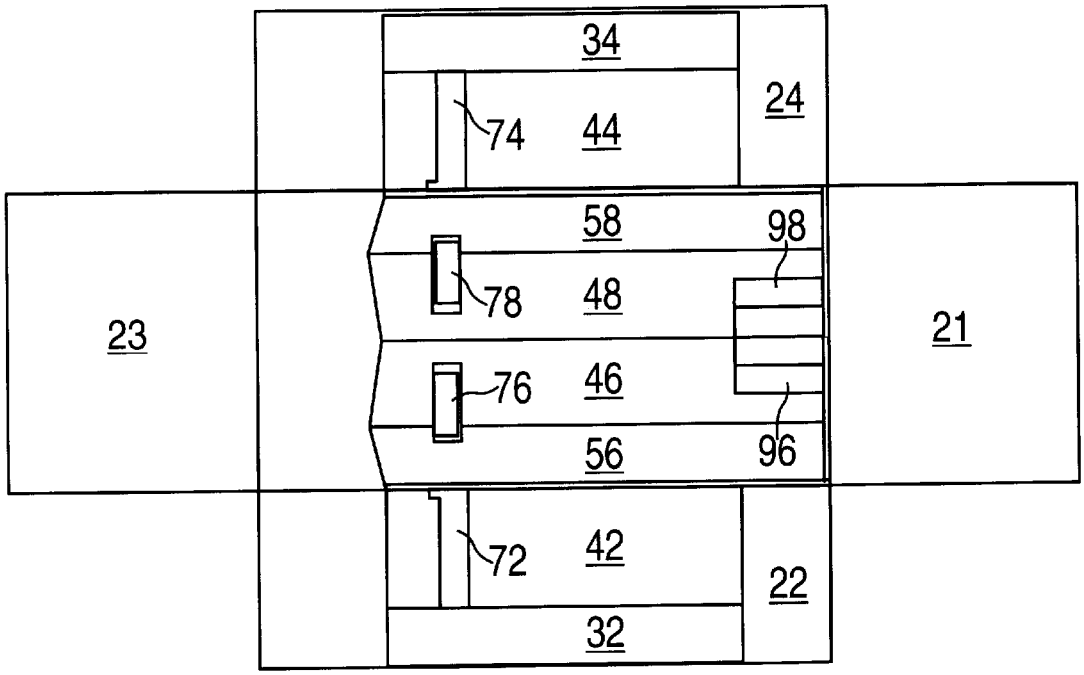
FIG. 3 is a top view of the packaging box of FIG. 1, with its top panels open.
Figure 4:
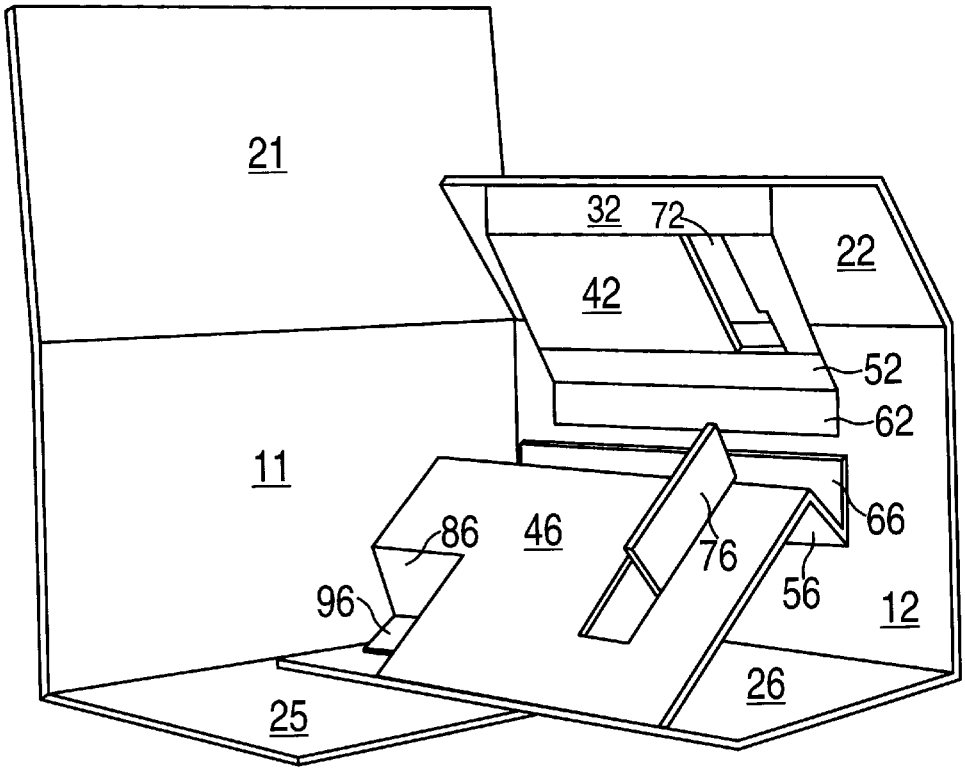
FIG. 4 is a perspective view of the packaging box of FIG. 1, with panels removed to show details of the inside of the box.

Once the box is ready to be erected to have the goods or items placed in it, the side panels 11 to 14 can be "squared-up", e.g., by pivoting the sides panels 11 to 14 so that they form a perimeter, e.g., a rectangular perimeter, around an internal space. Then, the bottom panels 25 to 28 may be folded into their closed positions, causing the inner panels 46 and 48 to move into their distanced positions in which they are displaced from the outer panels (i.e., the positions shown in FIG. 2). The goods may then be positioned in the box, supported on the inner panels 46 and 48, and then the top panels 21 to 24 may be moved into their closed positions, causing the inner panels 42 and 44 to move into their distanced positions in which they are displaced from the outer panels (as shown in FIG. 2). In this manner, the inner panels 42, 44, 46, 48 surround and provide cushioning and protection for the goods being shipped.

It will be appreciated that after the box 10 has been erected, it can be collapsed flat again by simply folding the panels in the reverse manner as used to erect the box. The box 10 then can be repeatably and easily erected again and collapsed flat again, without the need to unfasten any of the fastened panels from each other.

Various modifications may be made to the box depending on the desired features for the box (which may depend on the goods to be shipped). The box 10 shown in FIGS. 1 through 4 has side bracing flaps 76, 78 cut from the inner panels 46, 48 and distancing flaps 56, 58. The side bracing flaps 76, 78 help prevent goods from moving laterally inside the box.

The inner panels 42, 44 have cutouts 72, 74. In the illustrated embodiment, these cutouts 72, 74 are positioned above the side bracing flaps 76, 78. The side bracing flaps 76, 78 may be constructed to fit within these cutouts 72, 74 when the box is closed. The cutouts 72, 74 provide support for the side bracing flaps.

In the box shown in FIGS. 1 through 4, the inner panels 46 and 48 extend to nearly abutting the outer side panel 11, but do not extend all the way to the opposite outer side panel 13. This leaves a space between the ends of the inner panels 46, 48 and the outer side panel 13 for accommodating any item, or part of an item (e.g, a flange of an item) that may be suited to be shipped in such a space. In such a space, the item, or part of an item, is supported by the side panel 13 as well as by the edges of the inner panels 46 and 48 and the distancing flaps 56 and 58. Similarly, the inner panels 42 and 44 do not extend all the way to either side panel 11 or side panel 13, leaving spaces for accommodating an item or part of an item. Of course, any or all of the inner panels 42, 44, 46, 48 may or may not extend all the way to the side panel 11 or 13, as desired for the particular application.

Inner panels 46 and 48 have downwardly extending flaps 86, 96, 88, 98. These flaps create an opening through the inner panels 46 and 48 that extends down to the bottom panels 26 and 28. This again leaves a space for accommodating an item or part of an item, supported by the side panel 11, the bottom panels 26 and 28, the edges of the inner panels 46 and 48, and the downwardly extending flaps 86, 96, 88, 98. Similar spaces may be created in other places in the inner panels and/or distancing flaps. Similarly, the spaces of cutouts 72, 74, and/or the spaces created in inner panels 46 and 48 and distancing flaps 56 and 58 by the side bracing flaps 76 and 78, may also be used to accommodate and support items or parts of items being shipped.

Figure 7:
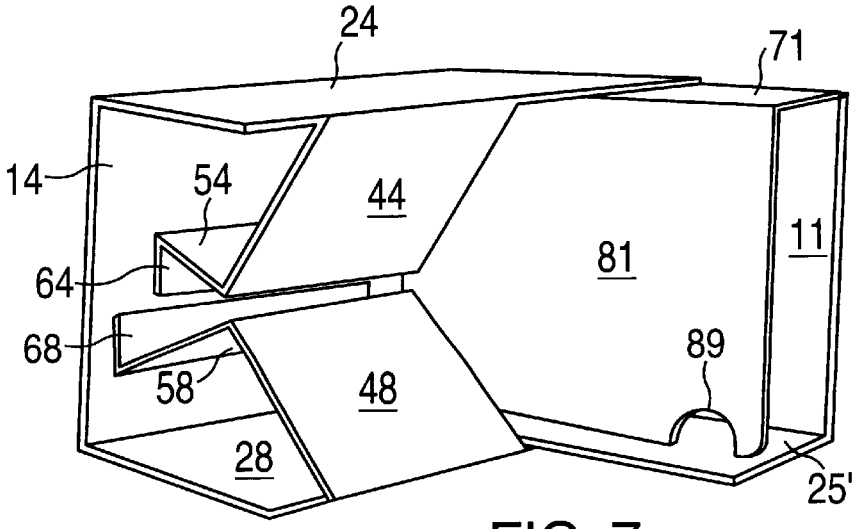
FIG. 7 is a perspective view of the packaging box of FIG. 6, with panels removed to show details of the inside of the box.
Figure 6:
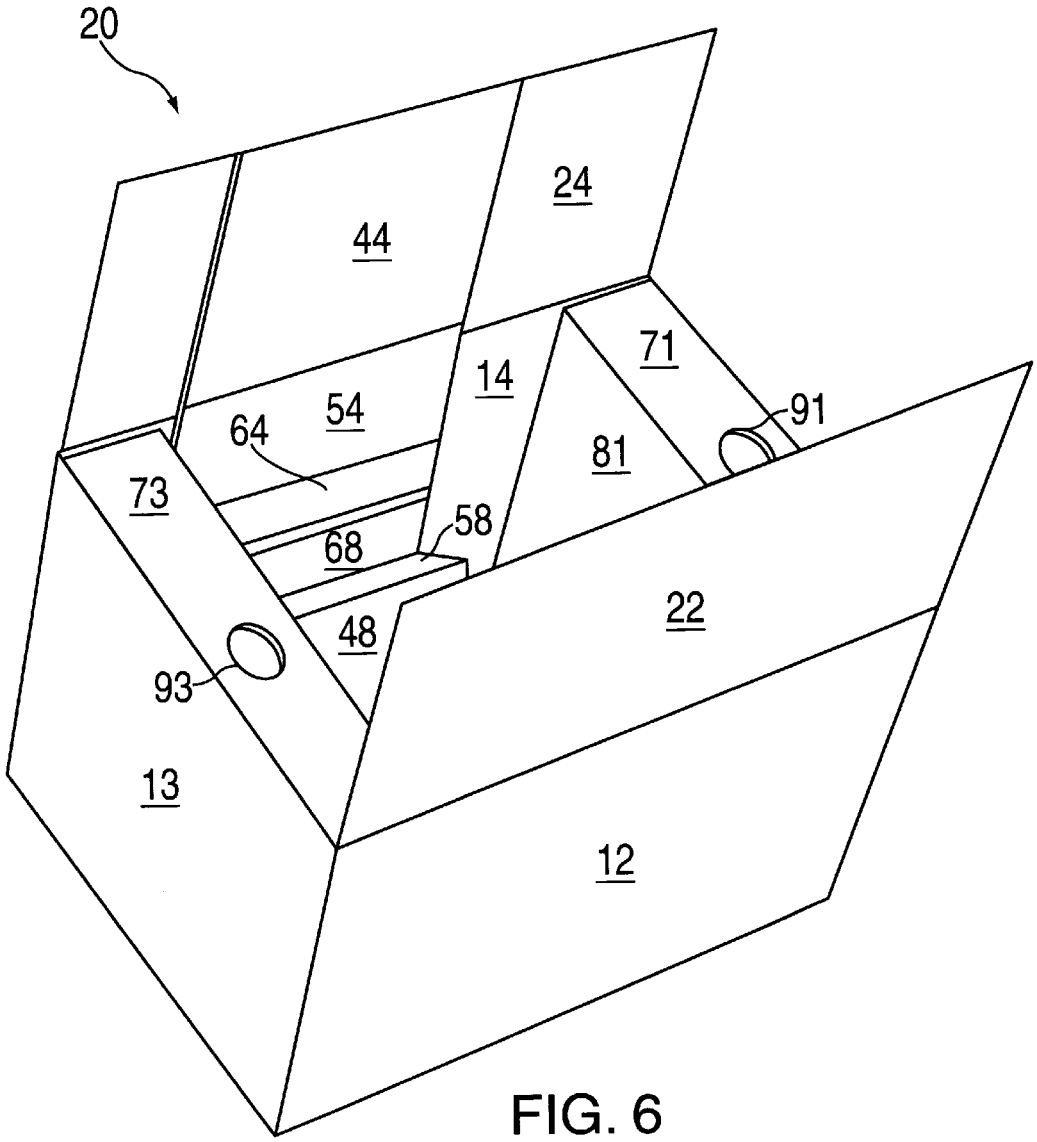
FIG. 6 is a perspective view of a second embodiment of a packaging box provided with an angled inner panel construction according to the present invention, with its top panels open.

FIGS. 6 and 7 show a box 20 having outer side panels 11 to 14, two top panels 22 and 24, and four bottom panels 25 to 28. Like the box 10 of FIGS. 1 to 4, the box 20 shown in FIGS. 6 and 7 has a plurality of inner panels 42, 44, 46 and 48 that, in an erected condition of the box 20, extend on the inside of the box to space goods being shipped from the outer panels of the box and thereby protect the goods.

In the embodiment illustrated in FIGS. 6 and 7, the box 20 additionally has inner side flaps 81, 83 which are positioned in the internal space of the box, distanced from the respective outer side panel 11 or 13 by a distancing flap 71 or 73. The inner side flaps 81, 83 serve to define further the internal space for the goods to be shipped, as bounded by the inner panels 42, 44, 46, 48 as well as by inner side flaps 81, 83. Clearance may be left between either or both of the inner side flaps 81, 83 and any or all of the inner panels 42, 44, 46, 48 for creating spaces for accommodating items or parts of items. The inner side flaps 81, 83 and their associated distancing flaps 71, 73 may also define their own internal compartments for containing goods. Access holes 91, 93 or access notches 89 may be provided to assist in opening these compartments, as well as to allow viewing of the contents of these compartments.

Figure 8:
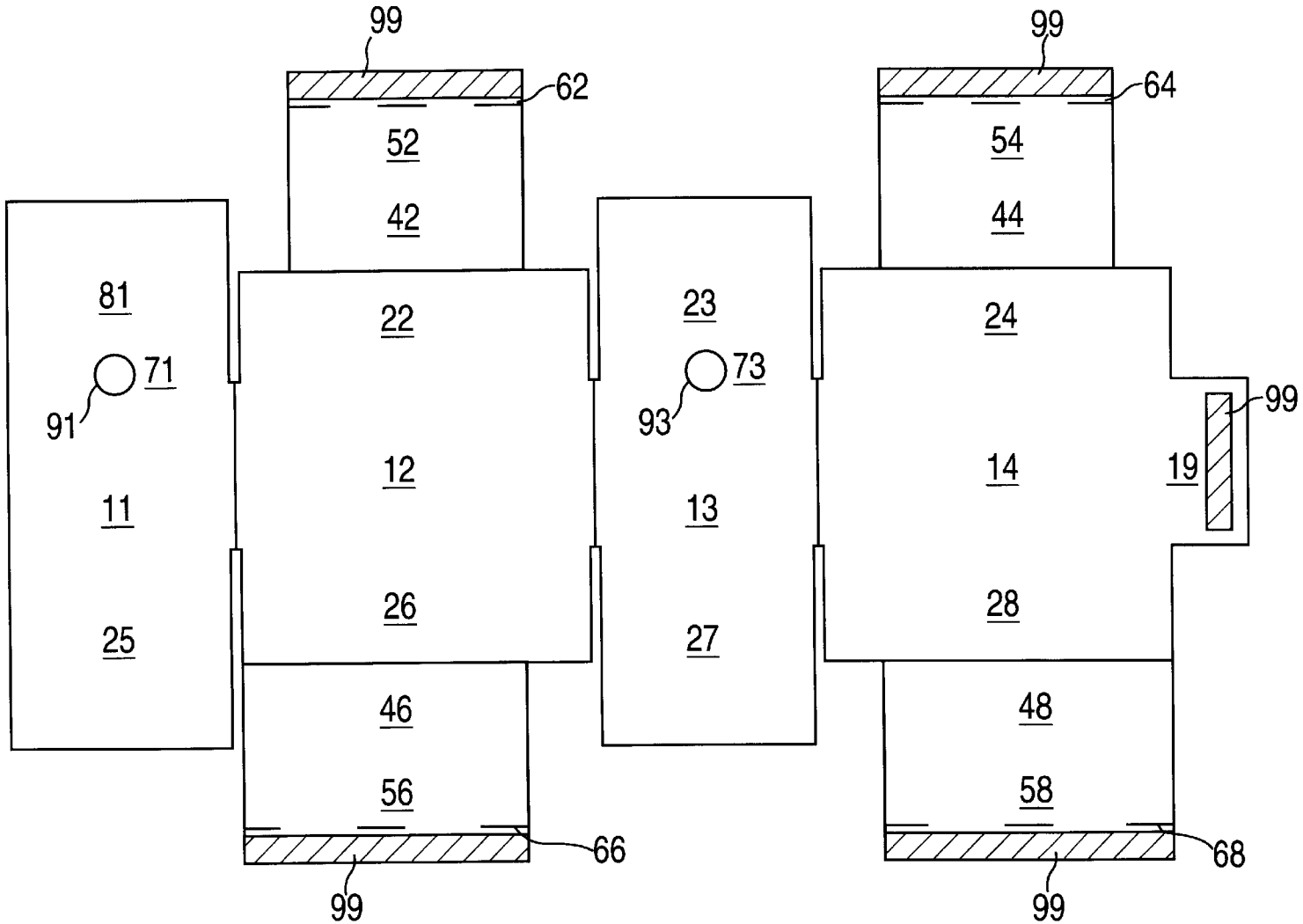
FIG. 8 shows a sheet from which the packaging box of FIGS. 6 and 7 can be formed by folding and connecting the respective associated portions thereof.
Figure 10:
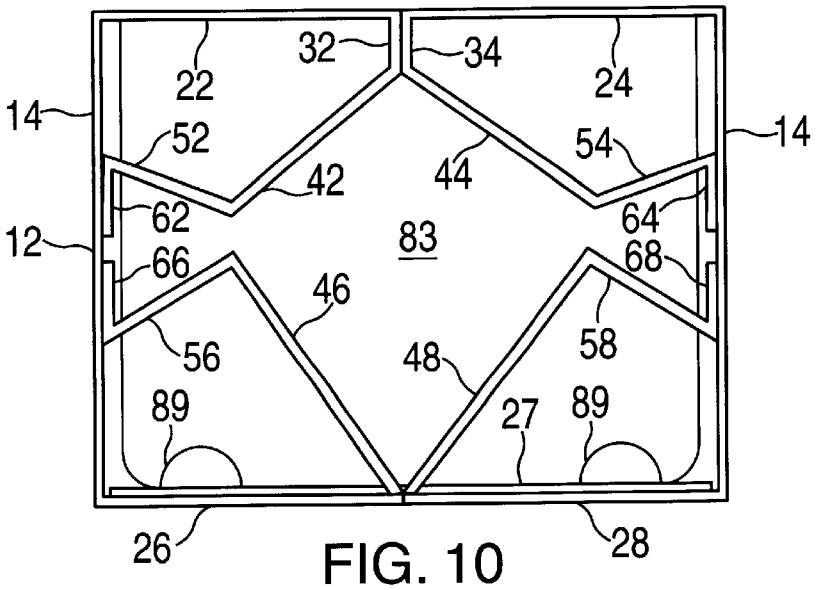
FIG. 10 is cross-sectional view taken through the packaging box of FIG. 9 in the plane indicated by and in the direction of the arrows 10—10 in FIG. 9.
Figure 9:
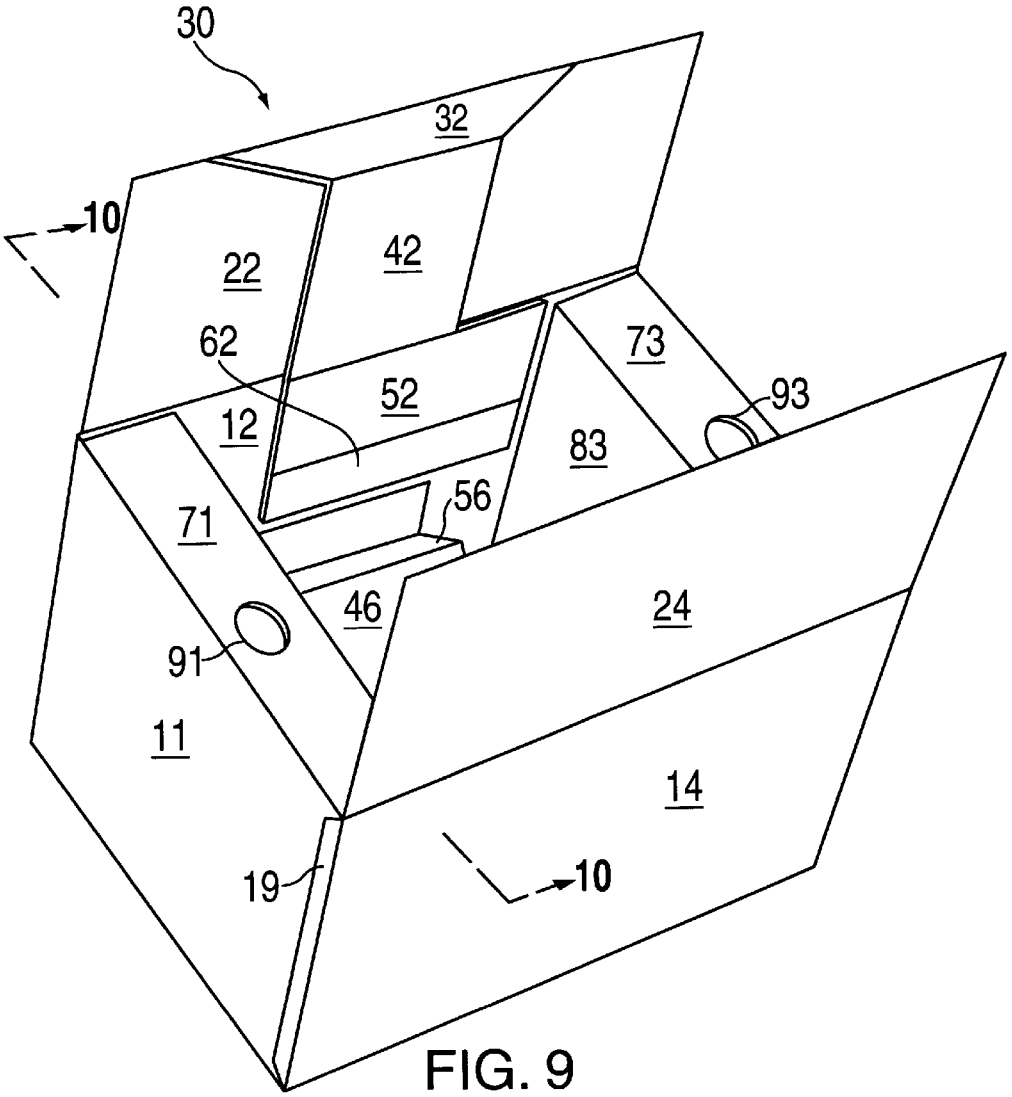
FIG. 9 is a perspective view of a third embodiment of a packaging box provided with an angled inner panel construction according to the present invention, with its top panels open.
Figure 11:
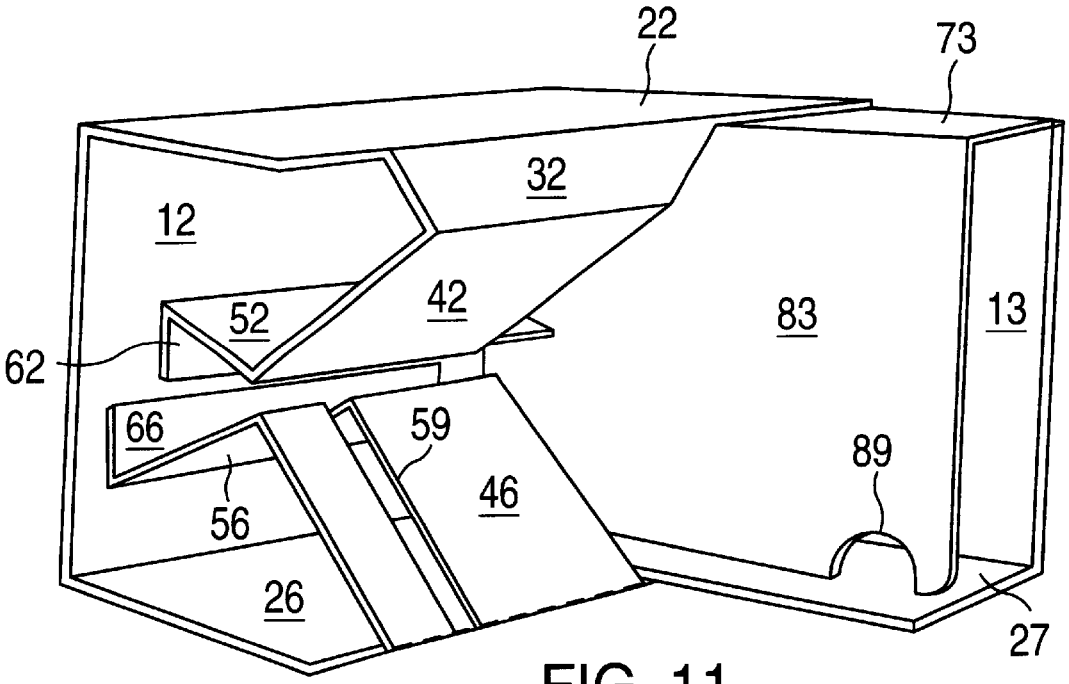
FIG. 11 is a perspective view of the packaging box of FIG. 9, with panels removed to show details of the inside of the box.
Figure 12:
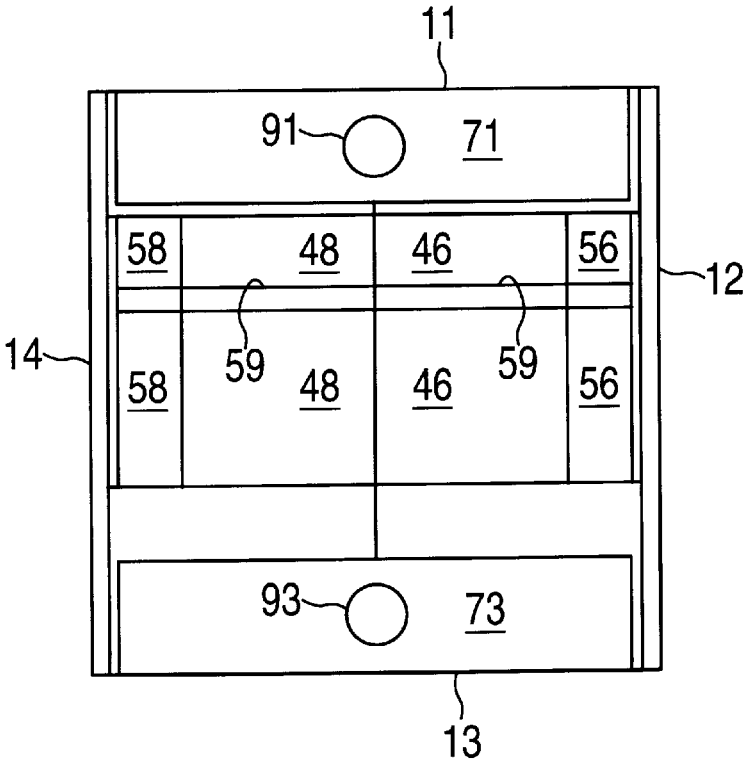
FIG. 12 is a top view of the packaging box of FIG. 9, with panels removed to show details of the inside of the box.

FIG. 8 shows a sheet for constructing the box 20. The outer side panels 11 to 14, the top and bottom panels 22, 24, 25 to 28, the inner panels 42, 44, 46, 48, the inner side flaps 81 and 83, the distancing flaps 52, 54, 56, 58, 71, 73 and the connecting flaps 19, 62, 64, 66, 68 are all integral parts of a single sheet. It should be noted that in FIG. 8, the optional notches 89 are not shown. Also, the bottom panels 25 and 27 in FIG. 8 are designed to be positioned on the outside of bottom panels 26 and 28 when the box 20 is closed; however, they may alternately be configured to be placed on the inside of bottom panels 26 and 28, as shown by bottom panel 25' in FIG. 7.

The box 20 operates similarly as the box 10 in terms of its ability to lie substantially flat in a pre-erected condition and to be repeatably and easily erected again and collapsed flat again without the need to unfasten any of the fastened panels from each other. One difference is that in erecting the box 20, after the bottom panels 25 to 28 have been closed (thereby moving the inner panels 46 and 48 into position), the inner side flaps 81, 83 are then folded into position, prior to closing the top panels 22, 24. Of course, to collapse the box the reverse steps are taken.

FIGS. 9 through 14 show a box 30 similar to the box 20 shown in FIGS. 6 and 7. The box 30 has outer side panels 11 to 14, two top panels 22 and 24, and four bottom panels 25 to 28. Like the box 10 of FIGS. 1 to 4 and the box 20 of FIGS. 6 and 7, the box 30 shown in FIGS. 9 through 14 has a plurality of protective inner panels 42, 44, 46, 48 that, in an erected condition of the box 30, extend on the inside of the space bounded by the outer side panels and the top and bottom panels.

Figure 13:
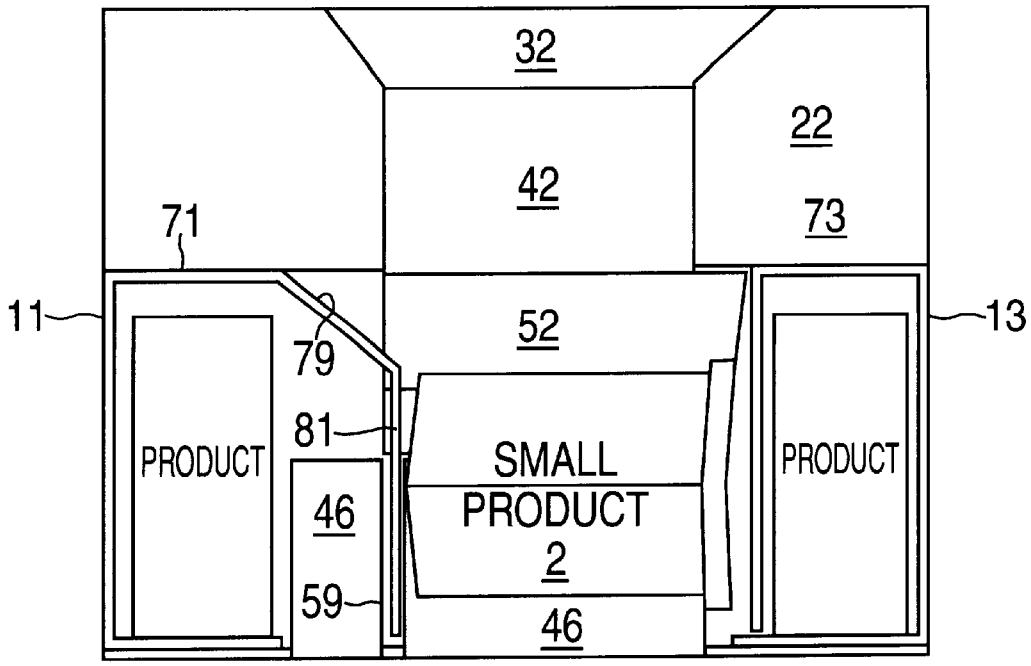
FIG. 13 is a cut away view of the inside of the packaging box of FIG. 9, with an adjustable panel in a first position.
Figure 14:
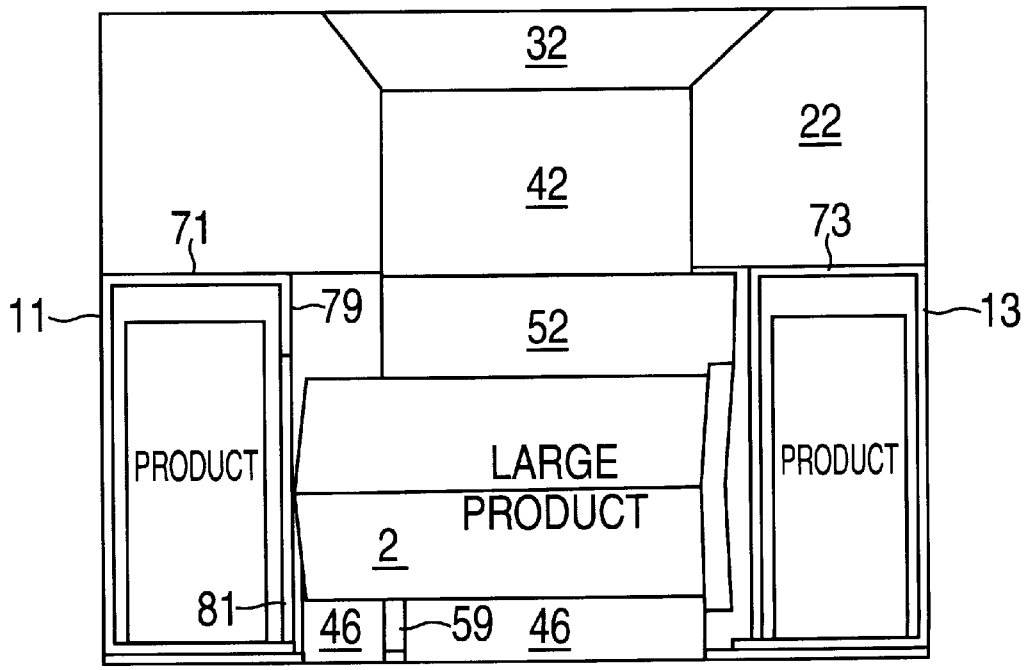
FIG. 14 is a view similar to that shown in FIG. 13, with the adjustable panel in a second position.

In the embodiment illustrated in FIGS. 9 to 14, the box 30 has inner side flaps 81, 83 similar to those in box 20 as shown in FIGS. 6 and 7. In the box 30, the inner side flap 81 is adjustable to two different positions, depending on the goods to be shipped. The lower inner panels 46, 48 and their associated distancing flaps 56, 58 have slots 59 in them for accommodating the lower end of the inner side flap 81. Thus, the inner side flap 81 may be positioned in a first position in the slots 59 as shown in FIG. 13, leaving a smaller central compartment for a small product 1 as shown. Alternatively, the inner side flap 81 may be positioned in a second position on the side of the inner panels 46 and 48 as shown in FIG. 14, leaving a larger central compartment for a large product 2 as shown. An adjustable segment 79 allows the alternate positioning of the inner side flap 81.

Figure 15:
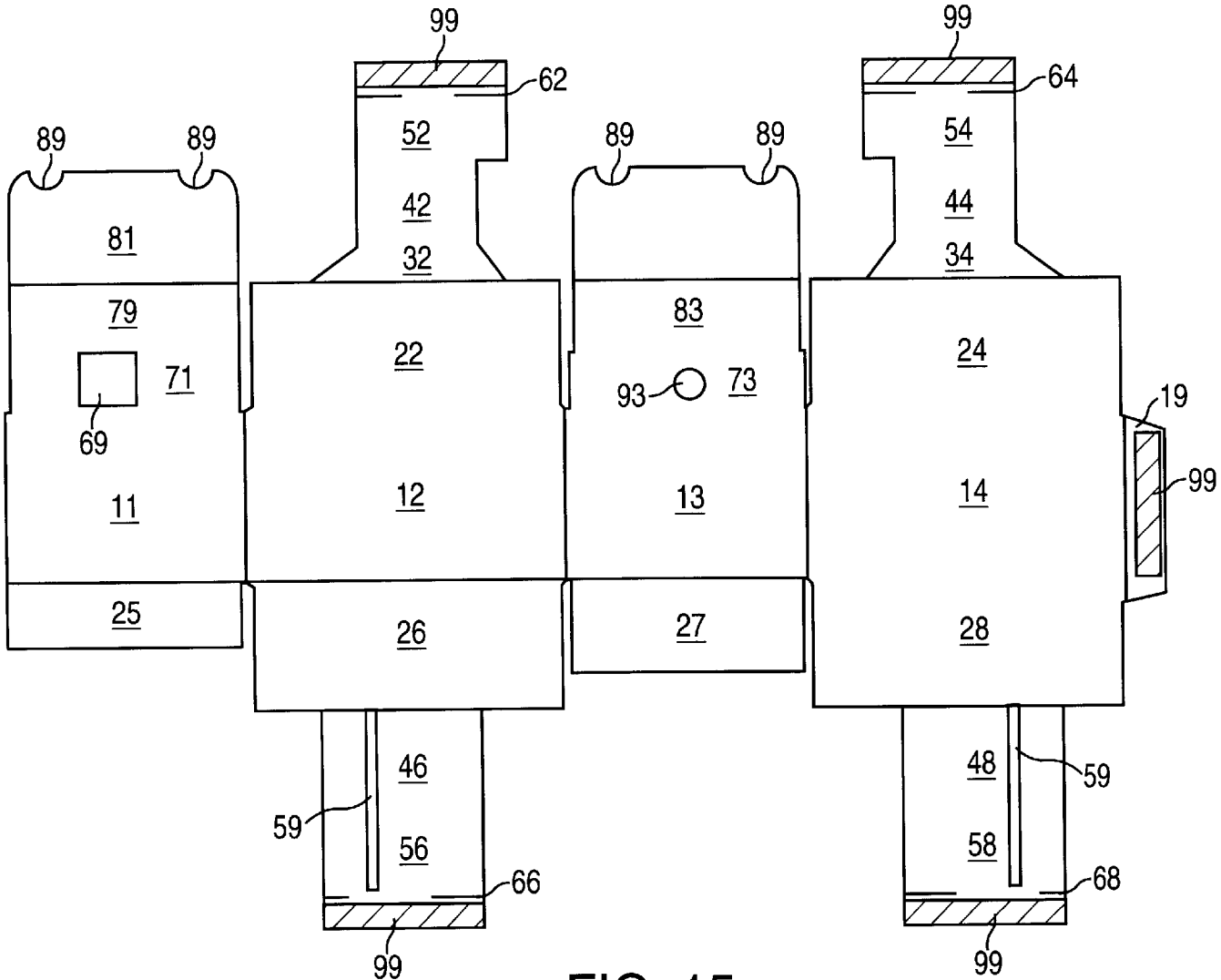
FIG. 15 shows a sheet from which the packaging box of FIGS. 9 through 14 can be formed by folding and connecting the respective associated portions thereof.

FIG. 15 shows a sheet for constructing the box 30. The outer side panels 11 to 14, the top and bottom panels 22, 24, 25 to 28, the inner panels 42, 44, 46, 48, the inner side flaps 81, 83, the adjustable segment 79, the distancing flaps 32, 34, 52, 54, 56, 58, 71, 73 and the connecting flaps 19, 62, 64, 66, 68 are all integral parts of a single sheet. It should be noted that in FIG. 15, the circular access hole 91 is not shown. An alternative construction, comprising a foldable panel 69, is shown in FIG. 15. Alternatively, two or more such foldable panels (such as two foldable doors) may be used. The foldable panel 69, or a plurality of foldable panels, similarly assists in opening and/or viewing the compartment bounded by inner side flap 81, adjustable segment 79 and distancing flap 71. The foldable panel or panels may also be used to help hold an item or items in the compartment in position. The edges of the foldable panel 69 or similar foldable panels may abut the adjacent panels, e.g., panels 11 and 79, to support them.

The box 30 operates similarly as the box 20 in terms of its ability to lie substantially flat in a pre-erected condition and to be repeatably and easily erected again and collapsed flat again.

Figure 16:
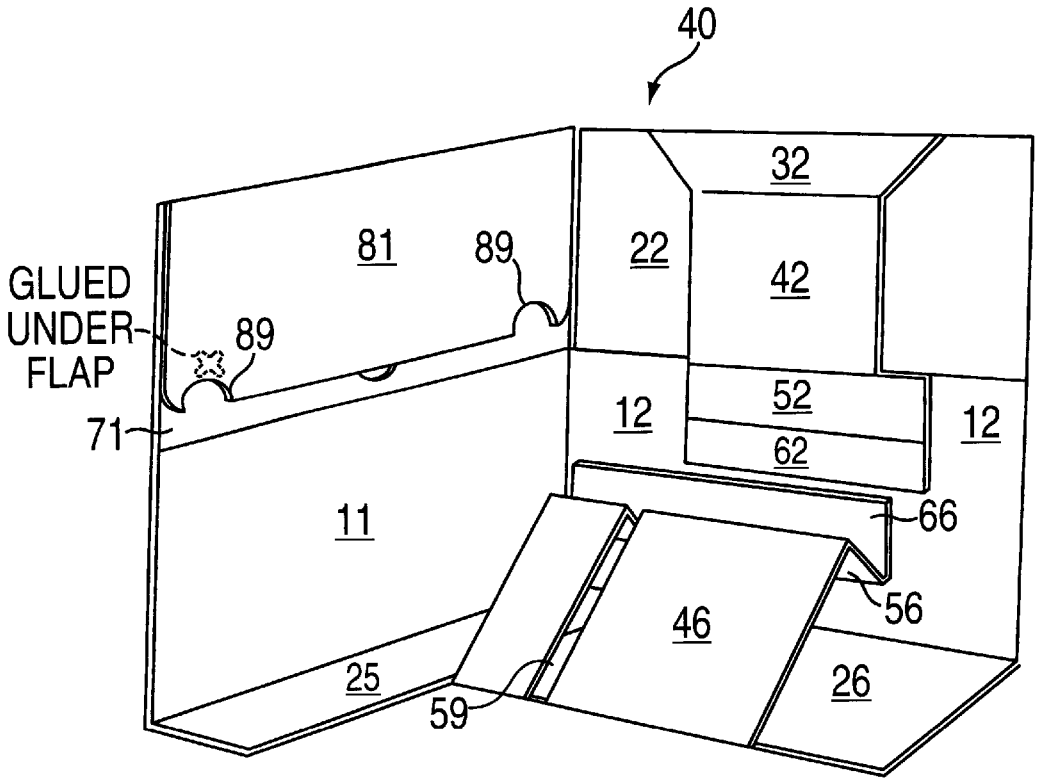
FIG. 16 is a perspective view of a fourth embodiment of a packaging box provided with an angled inner panel construction according to the present invention, with panels removed to show details of the inside of the box, and with a glued-down adjustable panel in a position prior to use.
Figure 17:
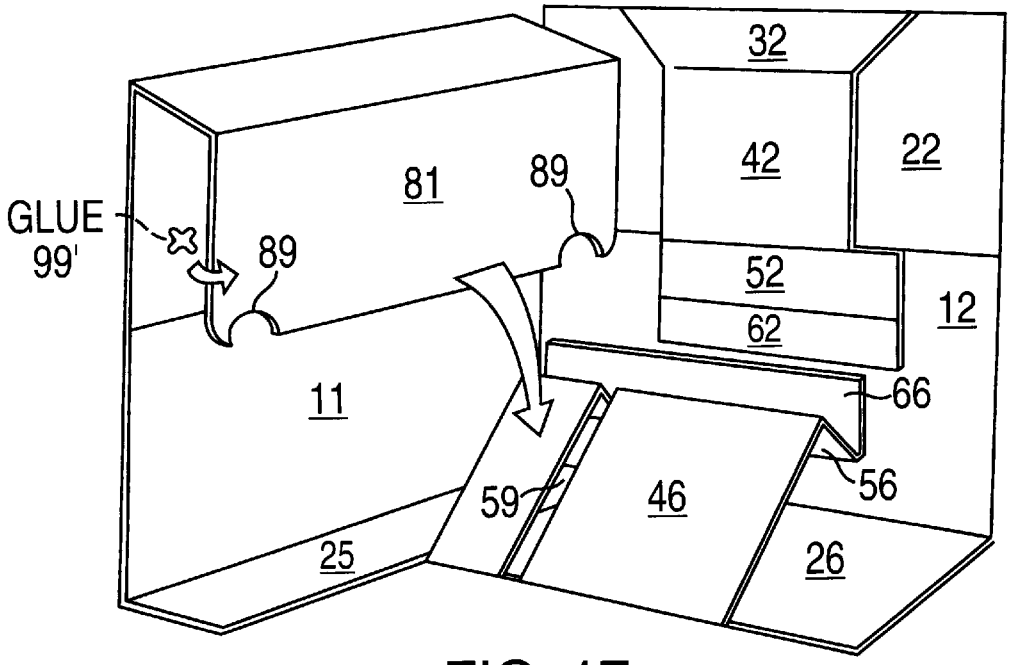
FIG. 17 is a view similar to that shown in FIG. 16, with the adjustable panel being moved into position.
Figure 18:
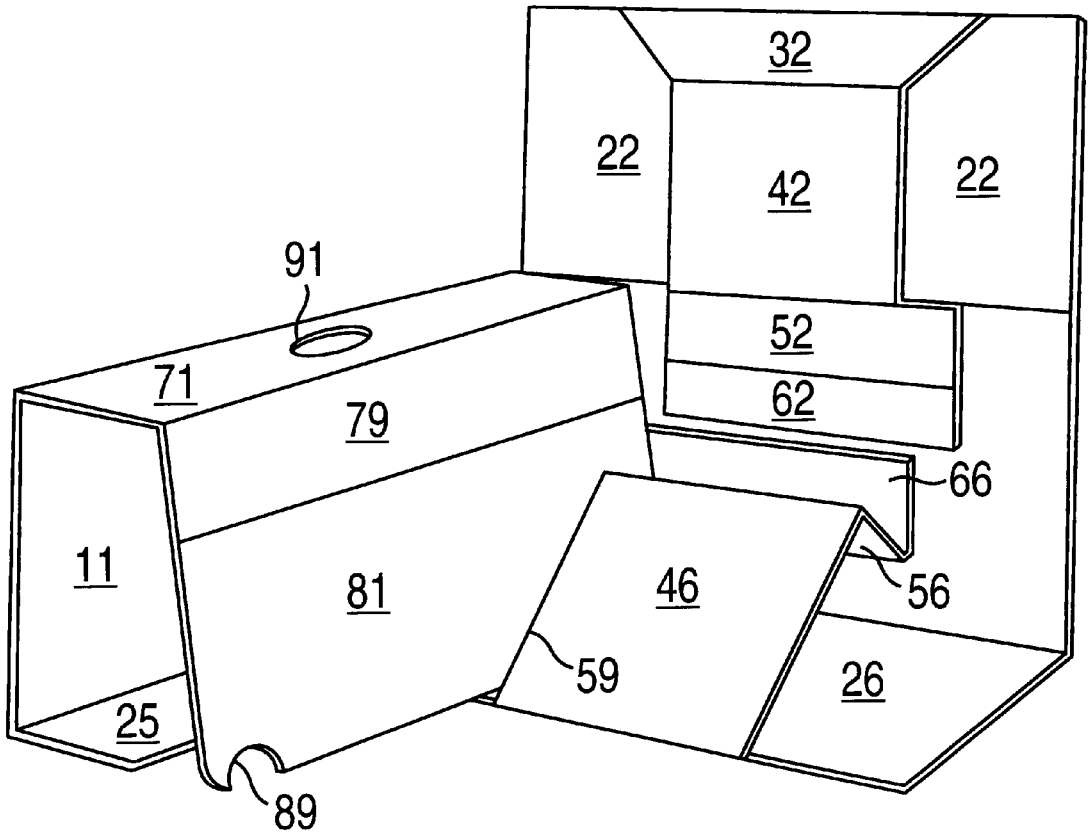
FIG. 18 is a view similar to that shown in FIG. 17, with the adjustable panel in an assembled position.

FIGS. 16 through 18 show a box 40 similar to the box 30 shown in FIGS. 9 through 14. In this embodiment, prior to erecting the box, the inner side flaps 81, 83 are attached, for example by a glue bead 99', to the respective distancing flap 71, 73. In this manner, the inner side flaps 81, 83 may be held downward as shown in FIG. 16. Such a construction is useful for allowing the box to be erected using conventional assembly equipment, because it keeps the heights of the sides of the box relatively equal, as shown in FIG. 16.

During assembly, a force on the outside of the distancing flaps 71, 73, or pulling the inner side flaps 81, 83, will cause the inner side flaps 81, 83 to come unglued. Then the inner side flaps 81, 83 can be positioned in a similar manner as described above with respect to box 30.

Figure 19:
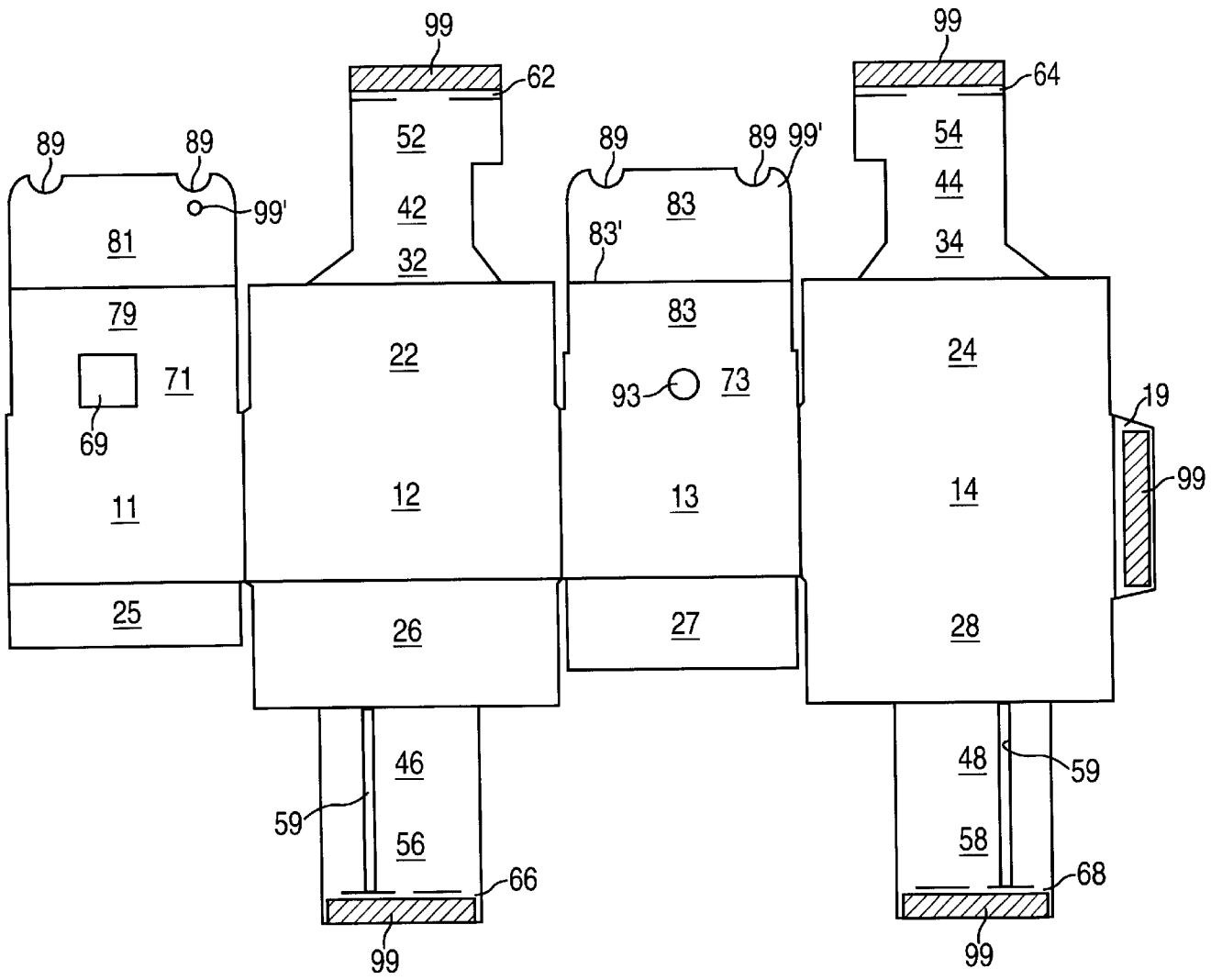
FIG. 19 shows a sheet from which the packaging box of FIGS. 16 through 18 can be formed by folding and connecting the respective associated portions thereof.
Figure 20:
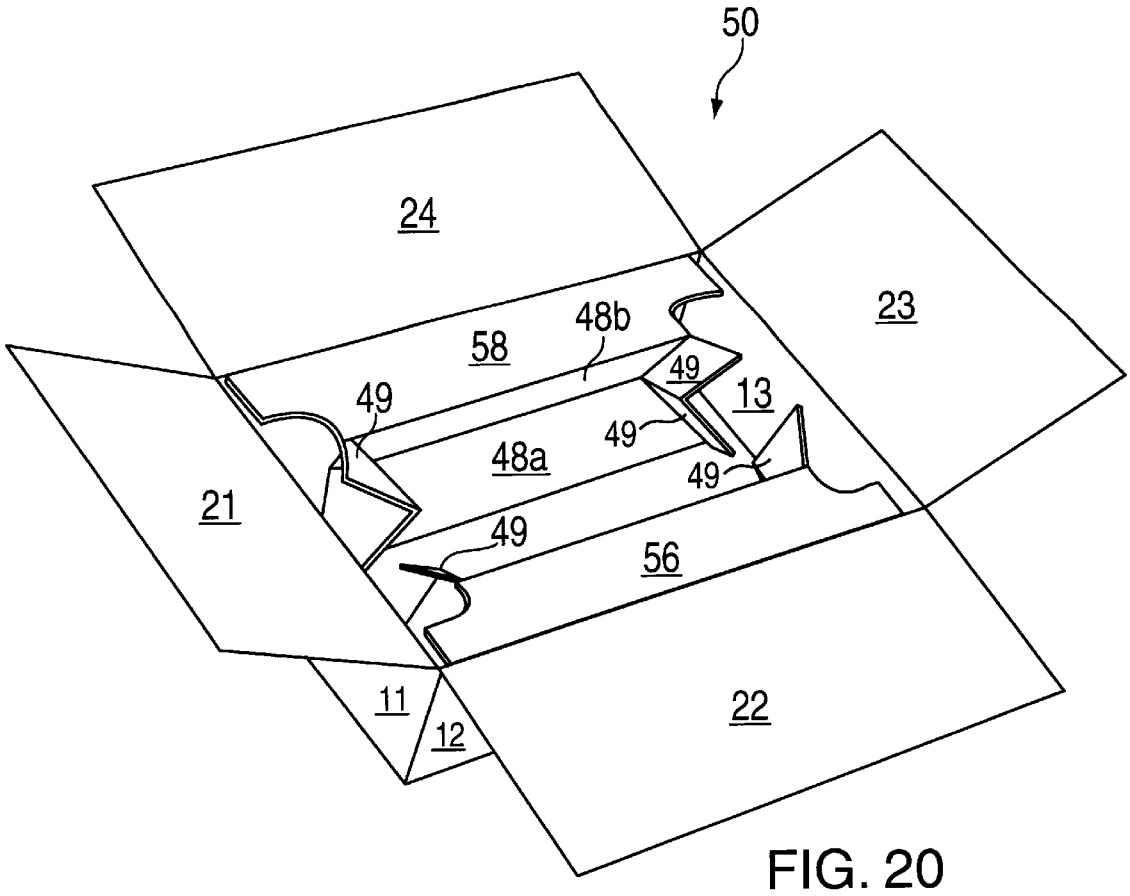
FIG. 20 is a perspective view of a fifth embodiment of a packaging box provided with an angled inner panel construction according to the present invention, with its top panels open.
Figure 21:
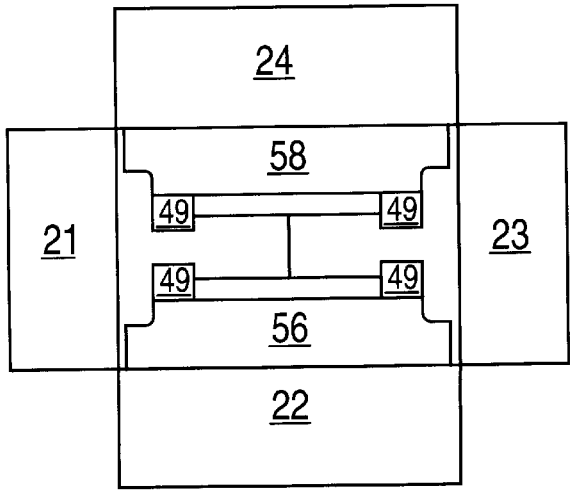
FIG. 21 is a top view of the packaging box of FIG. 20, with its top panels open.
Figure 22:
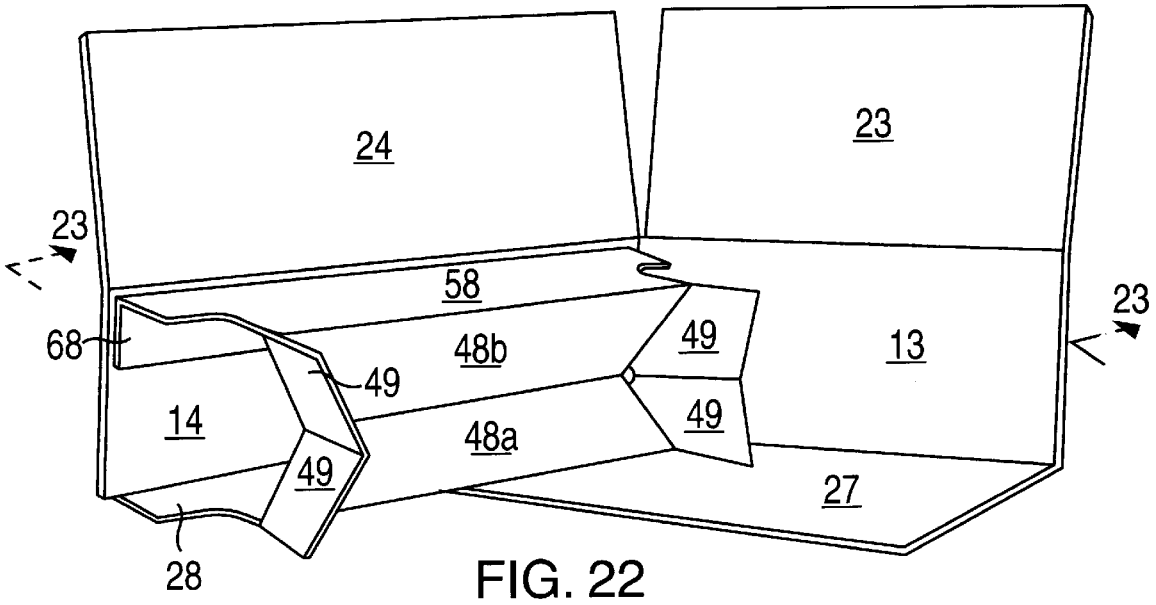
FIG. 22 is a perspective view of the packaging box of FIG. 20, with panels removed to show details of the inside of the box.
Figure 23:
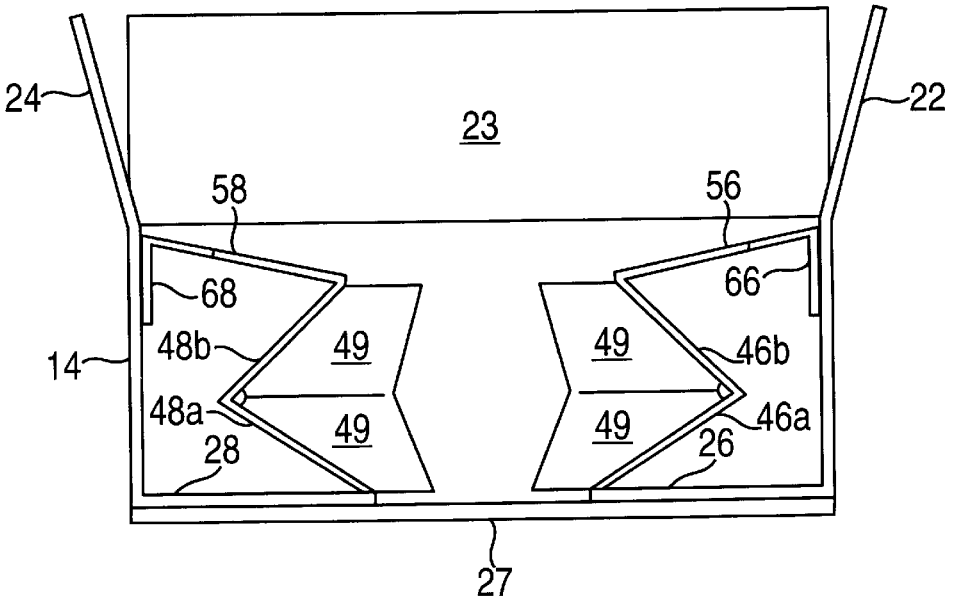
FIG. 23 is cross-sectional view taken through the packaging box of FIG. 22 in the plane indicated by and in the direction of the arrows 23—23 in FIG. 22.
Figure 24:
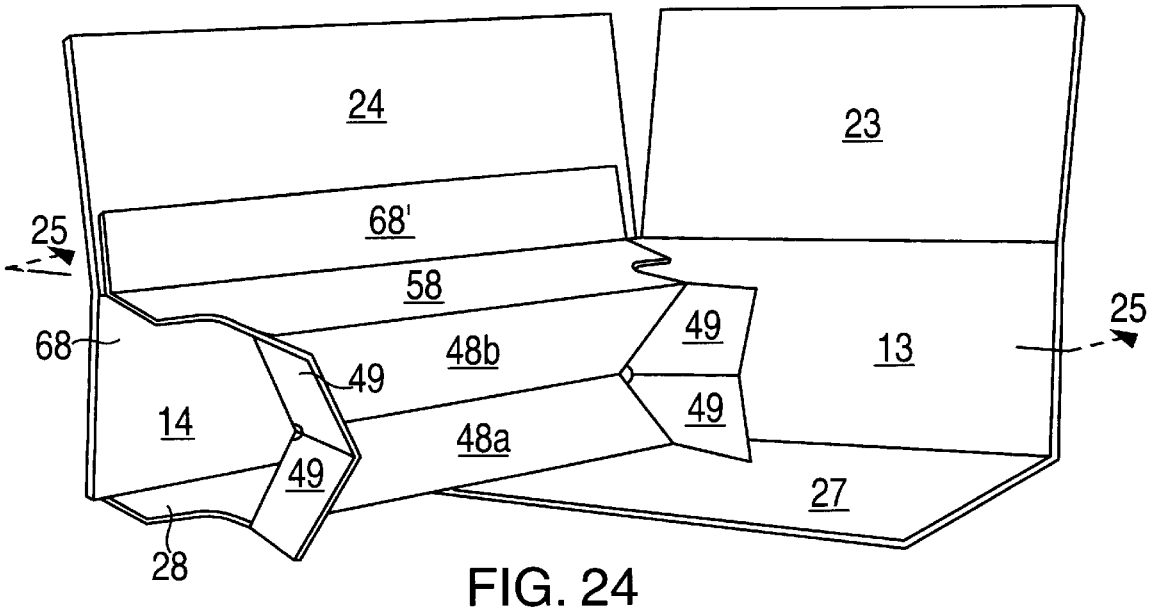
FIG. 24 is a perspective view of an alternate version of the packaging box of FIG. 20, with panels removed to show details of the inside of the box.
Figure 25:
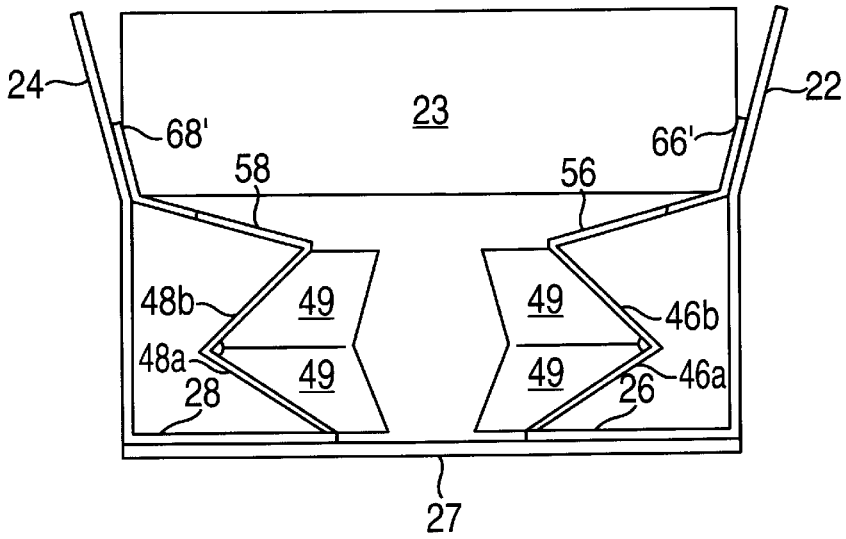
FIG. 25 is cross-sectional view taken through the packaging box of FIG. 24, in the plane indicated by and in the direction of the arrows 25—25 in FIG. 24.

As shown in FIG. 19, the inner side flap 83 may be provided with a fold line 83'. In the erected condition of the box, the inner side flap 83 may be folded slightly along that fold line 83'. The length of the inner side flap 83 may be selected to be longer than the side panels 11 to 14 of the box, to require that the inner side flap 83 be bent along the fold line 83' in order to allow the inner side flap 83 to fit in the box. Thus, the sections of the inner side flap 83 may be angled in the erected box.

FIGS. 20 through 23 show a box 50 having a plurality of outer side panels 11 to 14, top panels 21 to 24 and bottom panels 25 to 28. The box 50 is provided with inner panels 46, 48 separated by bend lines into inner panel sections 46*a*, 46*b*, 48*a*, 48*b* that extend on the inside of the box in an erected condition of the box. The inner panel sections 46*a*, 46*b*, 48*a*, 48*b* create recesses for receiving goods or items placed in the box and protect the goods or items during shipping.

In this illustrated embodiment, the inner panels 46, 48 extend from the bottom panels 26 and 28 and are positioned by the use of distancing flaps 56 and 58. Each distancing flap 56 and 58 is integrally connected to an edge of its respective inner panel section 46*b* or 48*b* and, on an opposite end, to a connecting flap 66 or 68. The connecting flap 66 or 68 is, in turn, joined to the respective outer side panel 12 or 14. Alternatively, each connecting flap 66, 68 may be folded in a direction opposite to that illustrated, so as to have its opposite side surface joined to the associated top panel 22 or 24. This alternative construction is shown in FIGS. 24 through 27, in which the connecting flaps 66' and 68' are joined to the top panels 22 and 24, respectively.

Wing flaps 49 may be provided on the ends of the inner panel sections 46*a*, 46*b*, 48*a*, 48*b*, as shown. In the collapsed condition of the box, and prior to closing the bottom panels 26 and 28, the wing flaps 49 are in the same plane as their respective inner panel sections. When the bottom panels 26 and 28 are moved into their closed positions, and the inner panels 46 and 48 move into their distanced positions, the wing flaps 49 are rotated to serve as side bracing flaps as shown. With appropriate scoring, the wing flaps 49 may rotate into position automatically upon moving the bottom panels 26 and 28 into their closed positions.

Figure 26A:
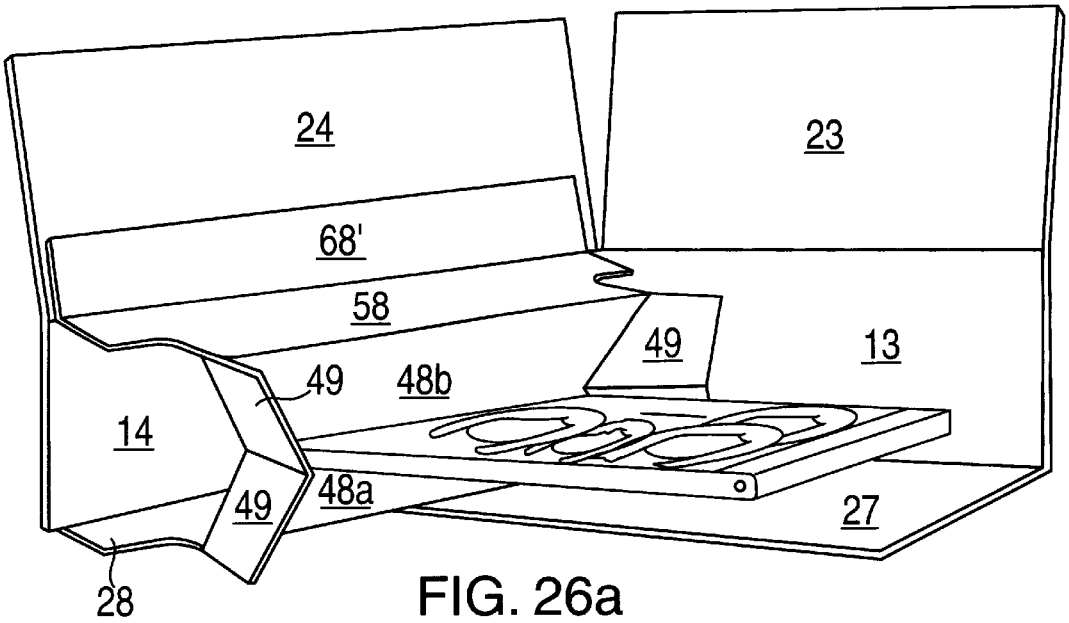
FIG. 26A is a view similar to that shown in FIG. 24, showing an object in the box.
Figure 26B:
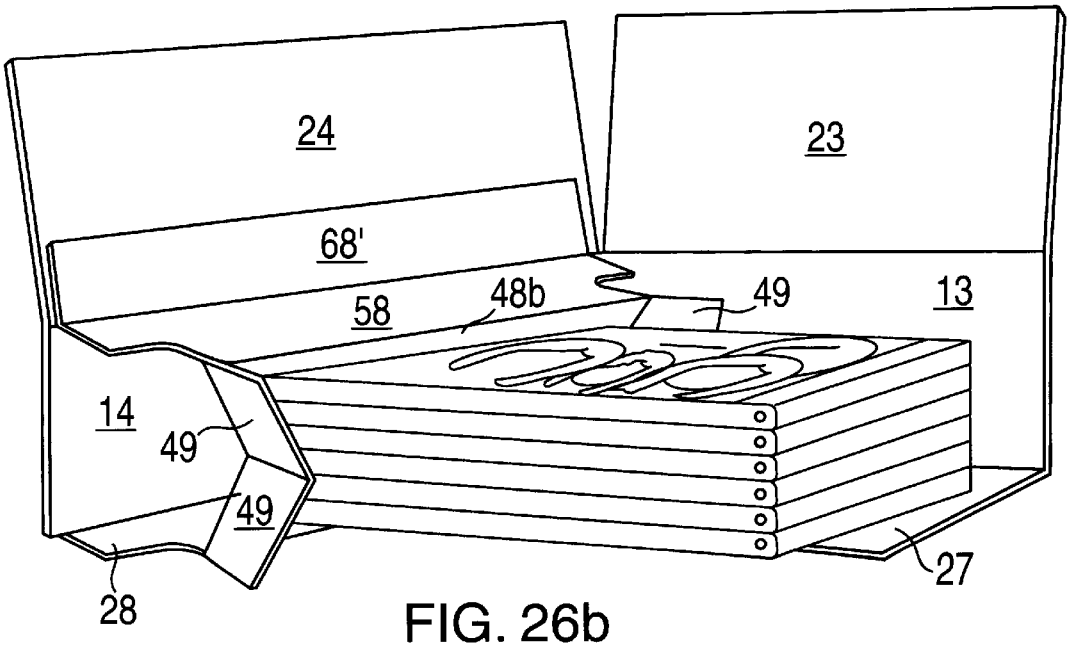
FIG. 26B is a view similar to that shown in FIG. 26A, showing multiple objects in the box.

As shown in FIGS. 26A and 26B, the box 50 accommodates goods or items of various heights. Thus, the box 50 may be used to ship a single item or multiple items, or small or large objects.

Figure 27A:
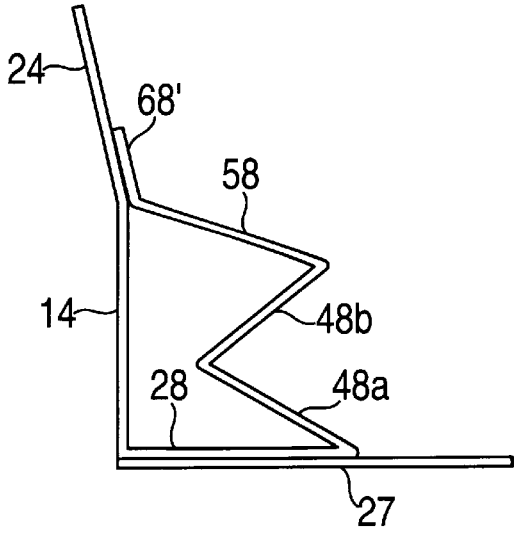
FIG. 27A is a view of a portion of the box as shown in FIG. 23, with the inner panel sections in neutral, central positions.

The box 50 may be constructed such that the angled inner panel sections 46*a*, 46*b*, 48*a*, 48*b* and the distancing flaps 56, 58 are able to act as shock absorbers for the goods being shipped. In such a construction, the inner panel sections 46*a*, 46*b*, 48*a*, 48*b* and the distancing flaps 56, 58 have neutral, central positions in which they lie when holding the goods being shipped (i.e., when the box is not being acted upon by any outside force (other than gravity)). FIG. 27A shows the inner panel sections 48*a*, 48*b* and distancing flap 58 in neutral, central positions, which correspond to the positions shown in FIG. 23. (In FIGS. 27A through 27C, the wing flaps 49 are not illustrated.)

Figure 27B:
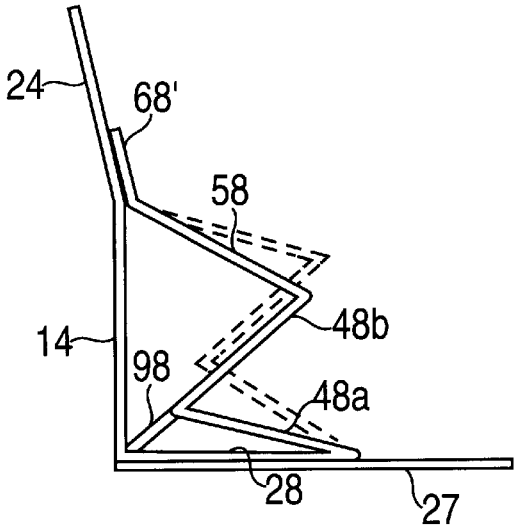
FIG. 27B is a view similar to FIG. 27A, with the inner panel sections in lower positions.

When, for example, the box 50 is dropped with its bottom side down, upon impact of the bottom panels with the ground the downward force of the goods on the inner panel section 48*a* causes the inner panel sections 48*a* and 48*b* and the distancing flap 58 to continue to move downward toward the bottom of the box. This is resisted somewhat by the tendency of the inner panel sections 48*a* and 48*b* and the distancing flap 58 to want to return to their neutral positions. This resistance increases as further displacement from the neutral positions takes place. FIG. 27B shows the inner panels sections 48*a* and 48*b* and the distancing flap 58 in their lower positions, with the neutral positions shown in phantom lines.

In FIG. 27B, a bracing tab 98 is shown extending downwardly from the inner panel section 48*b*. When such a bracing tab 98 is used, downward movement of the inner panel sections 48*a* and 48*b* is limited by the bracing tab 98 abutting against the side panel 14, the bottom panel 28, or, as shown in FIG. 27B, the corner where the side panel 14 meets the bottom panel 28. Otherwise, the downward movement may be limited by the inner panel section 48*a* abutting against the bottom panel 28. The use of a bracing tab 98 is described in more detail with reference to the embodiment shown in FIGS. 36 to 38.

Figure 27C:
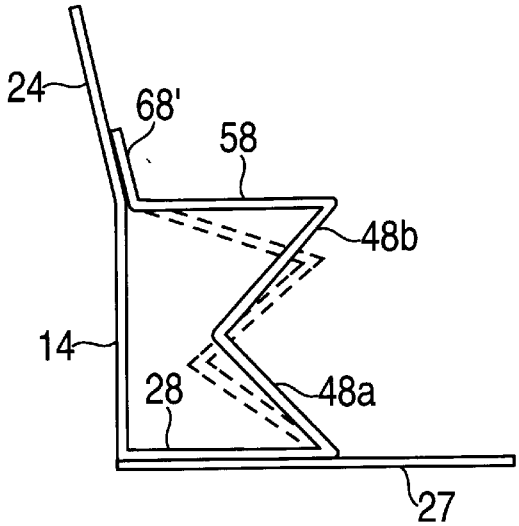
FIG. 27C is a view similar to FIG. 27A, with the inner panel sections in upper positions.

When the box 50 is dropped with its top side down, upon impact of the top panels with the ground the force of the goods on the inner panel section 48*b* causes the inner panel sections 48*a* and 48*b* and the distancing flap 58 to continue to move toward the top panels of the box. Again, this is resisted somewhat by the tendency of the inner panel sections 48*a* and 48*b* and the distancing flap 58 to want to return to their neutral positions. FIG. 27C shows the inner panels sections 48*a* and 48*b* and the distancing flap 58 in their upper positions ("upper" being used here to mean closer to the top panels of the box). Again, the neutral positions are shown in phantom lines. When the box 50 is closed, movement of the inner panel sections 48*a* and 48*b* toward the top panels of the box is limited by the distancing flap 58 abutting against one of the top panels.

It will be appreciated that this resiliency and variable positioning of the angled inner panel sections 46*a*, 46*b*, 48*a*, 48*b* and of the distancing flaps 56, 58, provides additional cushioning for items in the box. Their resiliency and movement absorbs some of the impact acting on the box in order to limit transmission of that impact to the goods being shipped.

Figure 28:
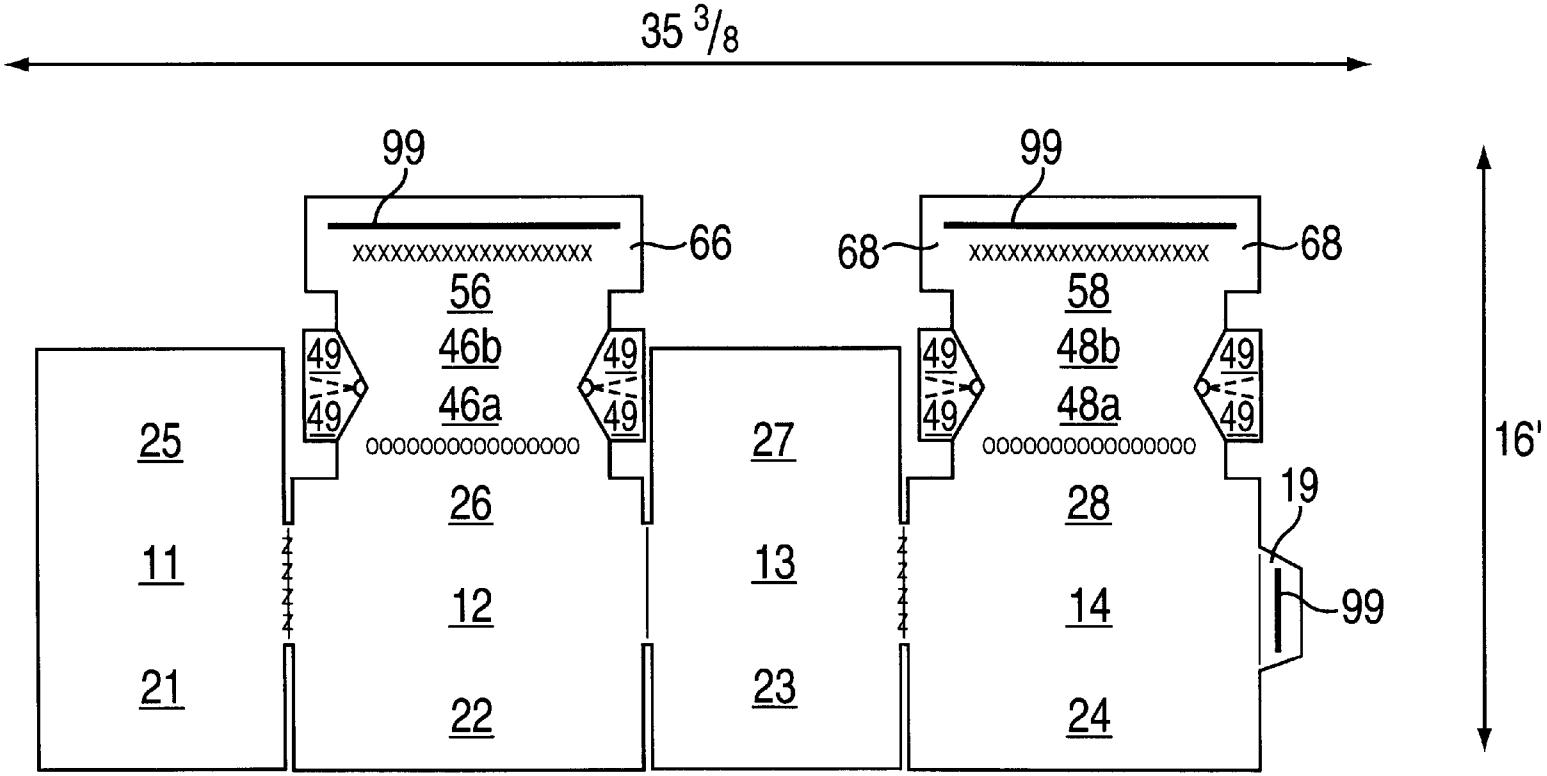
FIG. 28 shows a sheet from which the packaging boxes of FIGS. 20 through 27 can be formed by folding and connecting the respective associated portions thereof.
Figure 30:
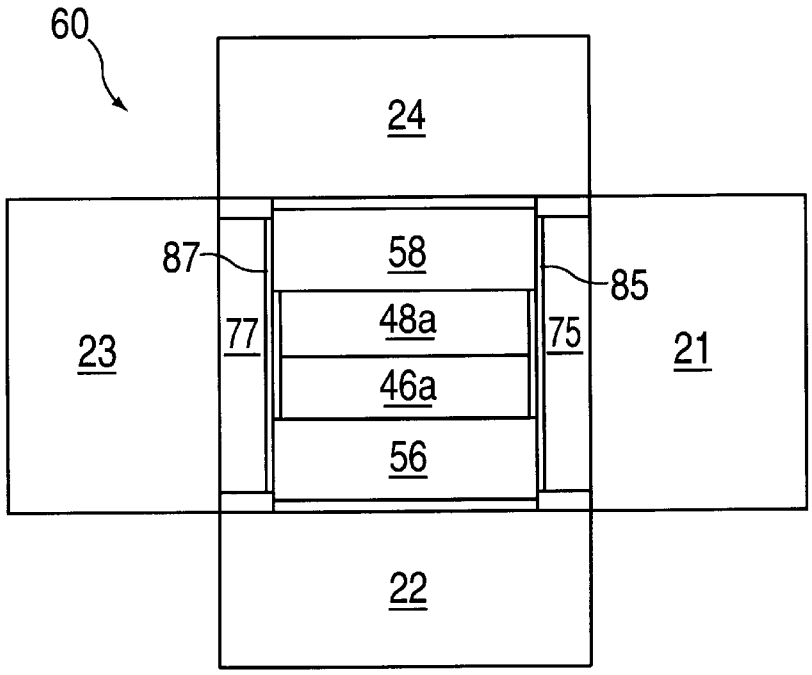
FIG. 30 is a top view of the packaging box of FIG. 29, with its top panels open.
Figure 29:
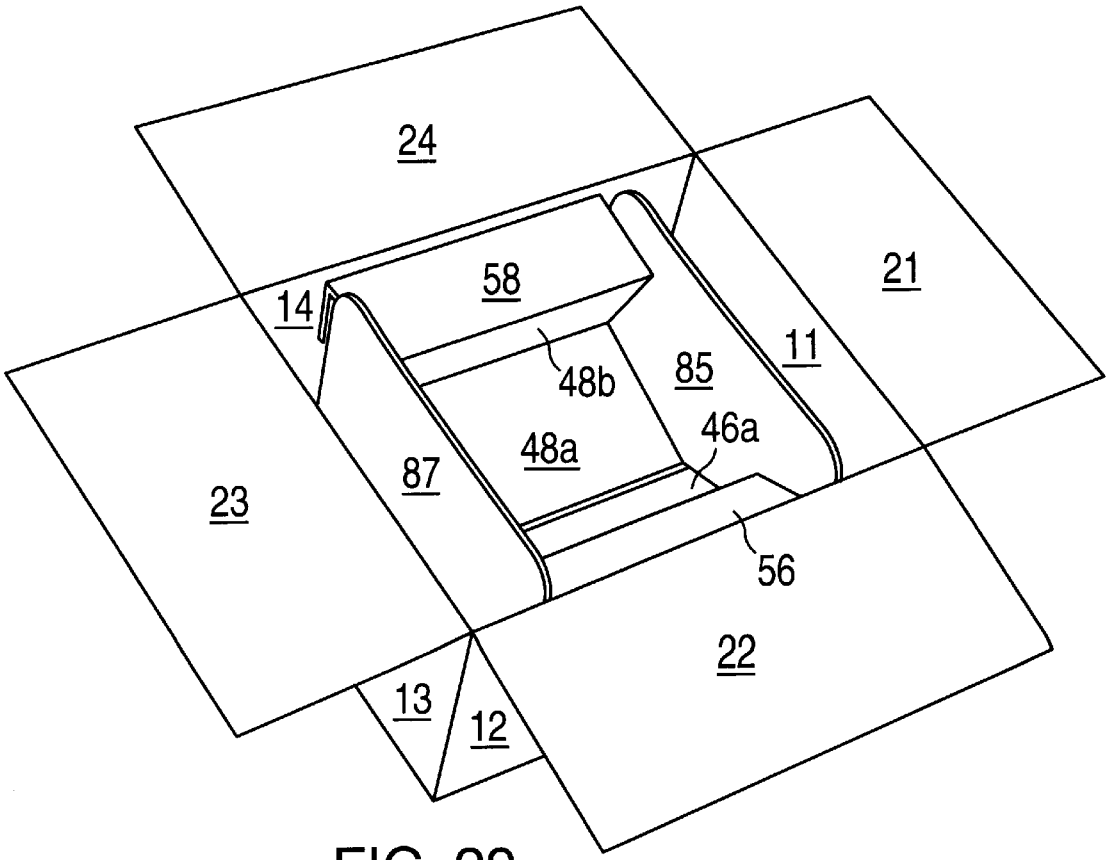
FIG. 29 is a perspective view of a sixth embodiment of a packaging box provided with an angled inner panel construction according to the present invention, with its top panels open.
Figure 31:
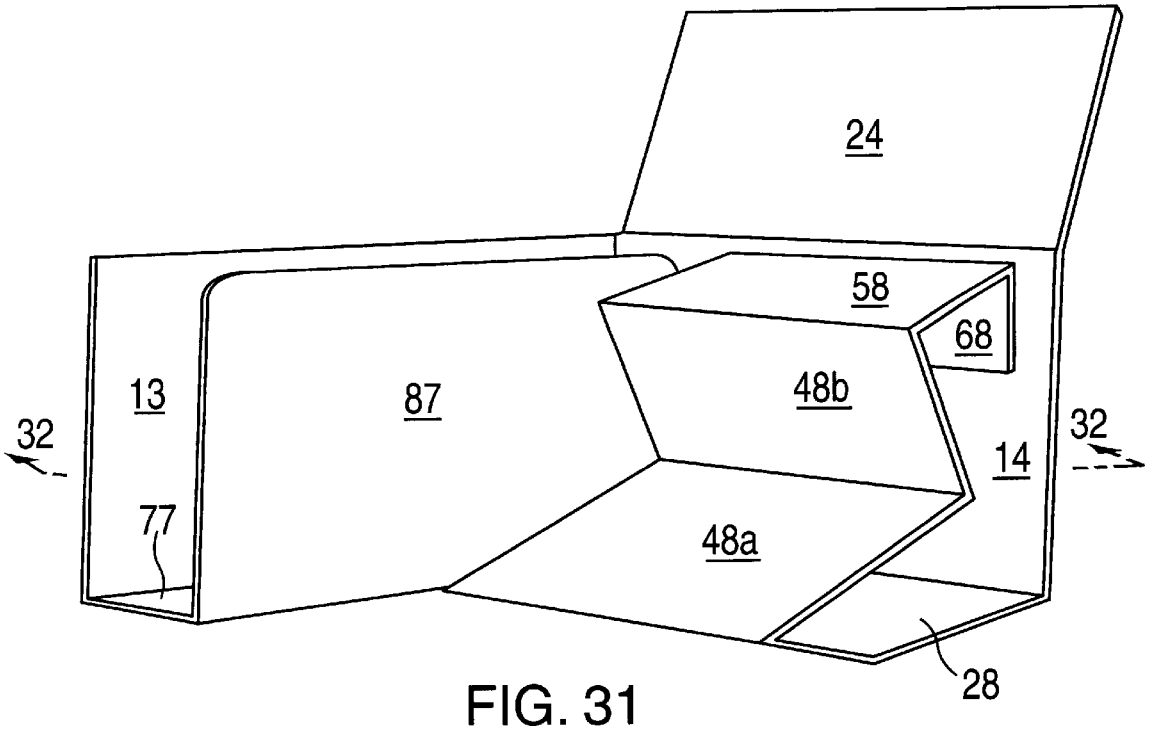
FIG. 31 is a perspective view of the packaging box of FIG. 29, with panels removed to show details of the inside of the box.
Figure 32:
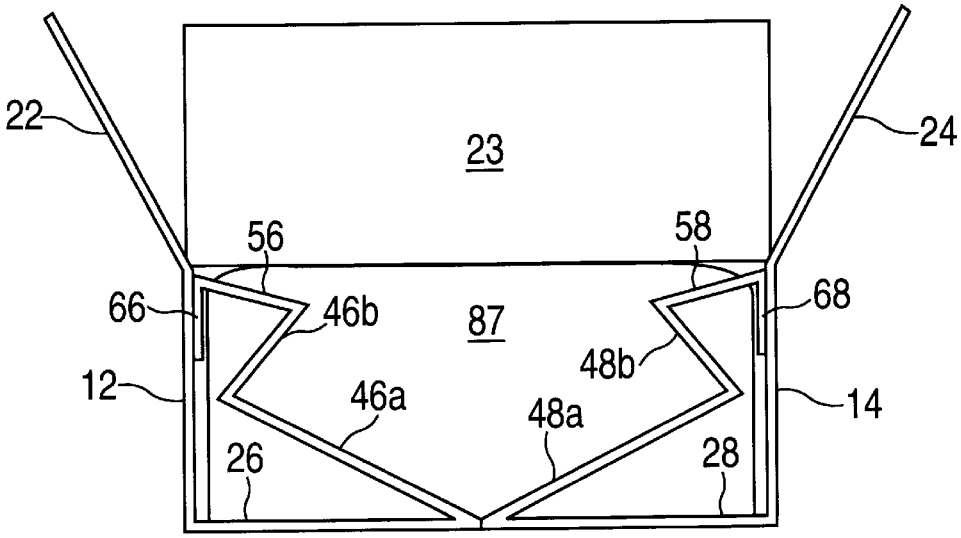
FIG. 32 is cross-sectional view taken through the packaging box of FIG. 31 in the plane indicated by and in the direction of the arrows 32—32 in FIG. 31.

FIG. 28 shows a sheet for forming the boxes of FIGS. 20 through 27. The outer side panels 11 to 14, the top and bottom panels 21 to 28, the inner panel sections 46*a*, 46*b*, 48*a*, 48*b*, the wing flaps 49, the distancing flaps 56, 58, and the connecting flaps 19, 66, 68 all are integral parts of a single sheet. The glue strips 99 on the connecting flaps 66 and 68 may be placed on the opposite sides of the connecting flaps depending on whether they will be joined as shown in FIGS. 20 through 23 or as shown in FIGS. 24 through 27.

FIGS. 29 through 32 show a box 60 having a plurality of outer side panels 11 to 14, top panels 21 to 24 and bottom panels 26 and 28. Similar to the box 50, the box 60 has inner panels 46, 48 separated by bend lines into inner panel sections 46*a*, 46*b*, 48*a*, 48*b* that extend on the inside of the box and that create recesses for receiving items to protect the items during shipping.

The inner panels 46, 48 extend from the bottom panels 26 and 28 and are positioned by the use of distancing flaps 56 and 58. Each distancing flap 56 and 58 is integrally connected to an edge of its respective inner panel section 46*b* or 48*b* and, on an opposite end, to a connecting flap 66 or 68. The connecting flap 66 or 68 is, in turn, joined to the respective outer side panel 12 or 14. Alternatively, each connecting flap 66, 68 may be folded in a direction opposite to that illustrated, so as to have its opposite side surface joined to the associated top panel 22 or 24. This alternative construction is shown in FIGS. 33 and 34, in which the connecting flaps 66' and 68' are joined to the top panels 22 and 24, respectively.

The box 60 has inner side flaps 85 and 87 which are positioned in the internal space of the box, distanced from the respective outer side panel 11 or 13 by a distancing flap 75 or 77 which connects the inner side flap 85 or 87 to the respective outer side panel 11 or 13. Whereas the inner side flaps 81 and 83 in earlier-described embodiments are connected by distancing flaps 71 and 73 to the tops of the side panels 11 and 13, in box 60 the inner side flaps 85 and 87 are connected by distancing flaps 75 and 77 to the bottoms of the side panels 11 and 13. The inner side flaps 85, 87 and their associated distancing flaps 75, 77 define compartments for containing goods.

Figure 33:
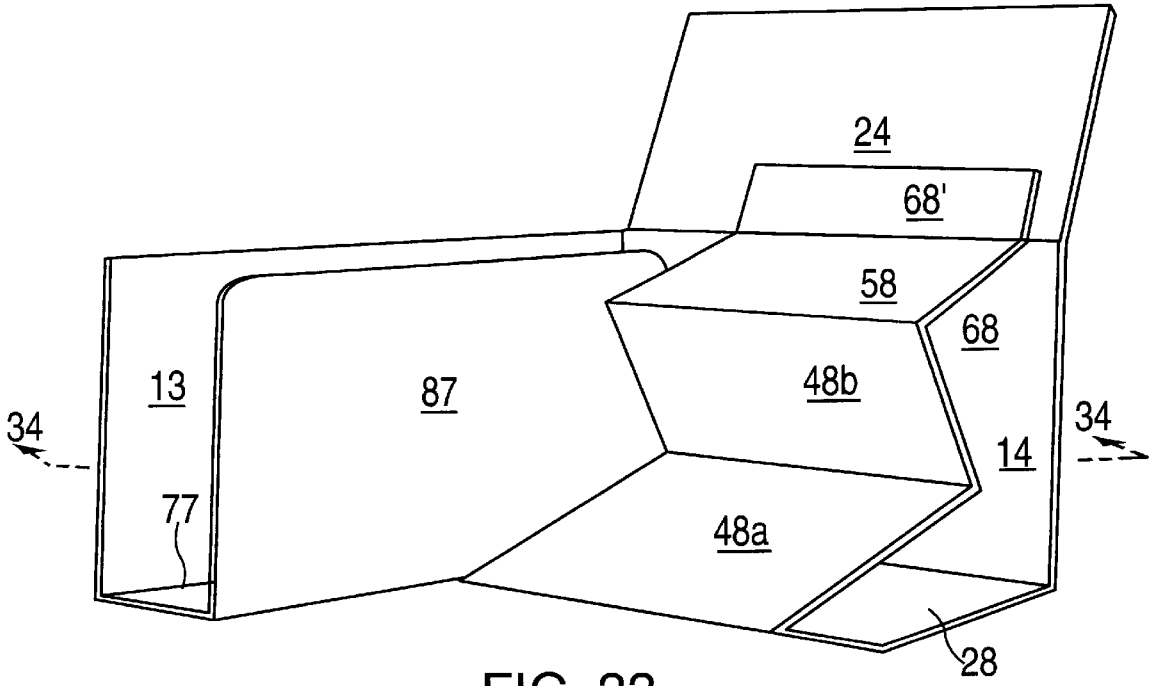
FIG. 33 is a perspective view of an alternate version of the packaging box of FIG. 29, with panels removed to show details of the inside of the box.
Figure 34:
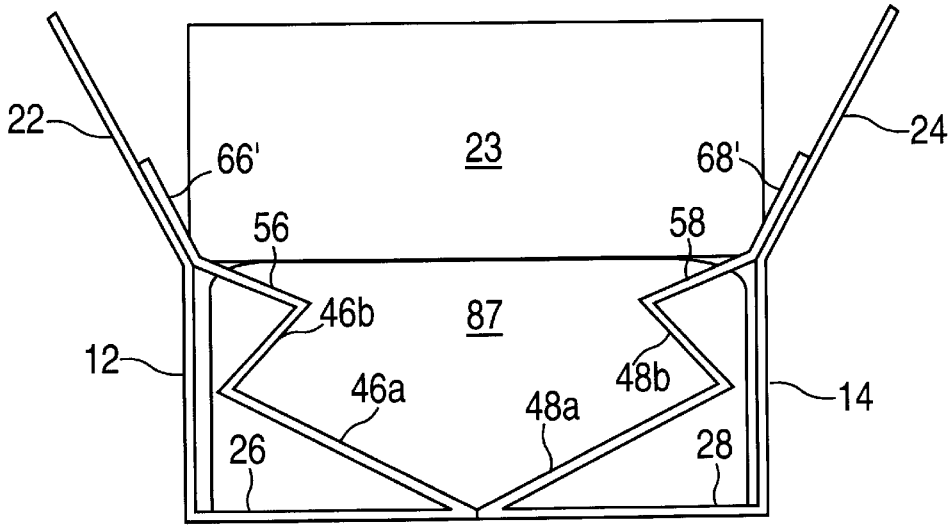
FIG. 34 is cross-sectional view taken through the packaging box of FIG. 33, in the plane indicated by and in the direction of the arrows 34—34 in FIG. 33.
Figure 35:
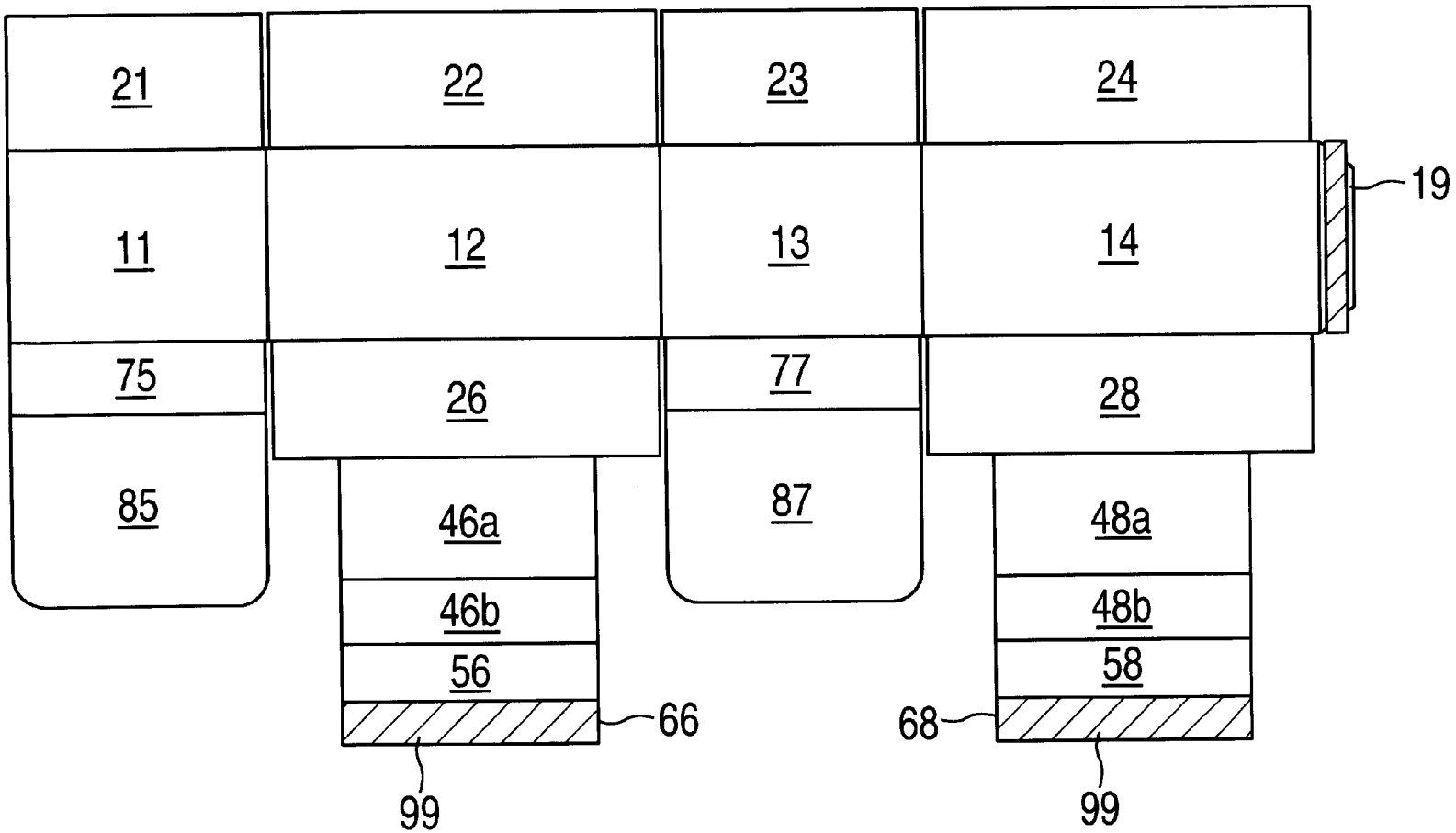
FIG. 35 shows a sheet from which the packaging boxes of FIGS. 29 through 34 can be formed by folding and connecting the respective associated portions thereof.

FIG. 35 shows a sheet for forming the boxes of FIGS. 29 through 34. The outer side panels 11 to 14, the top panels 21 to 24, the bottom panels 26 and 28, the inner panel sections 46*a*, 46*b*, 48*a*, 48*b*, the inner side flaps 85, 87, the distancing flaps 56, 58, 75, 77, and the connecting flaps 19, 66, 68 all are integral parts of a single sheet. The glue strips 99 on the connecting flaps 66 and 68 may be placed on the opposite sides of the connecting flaps depending on whether they will be joined as shown in FIGS. 29 through 32 or as shown in FIGS. 33 and 34.

Similarly to the box 50, the box 60 accommodates goods or items of various heights. Thus, similarly to the box 50 in FIGS. 26 and 27, the box 60 may be used to ship a single item or multiple items, or small or large objects.

Figure 36:
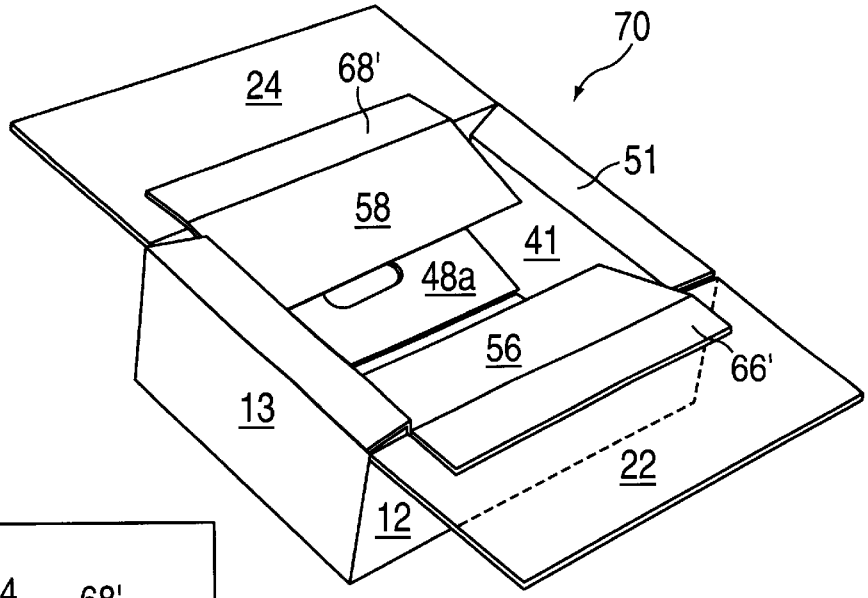
FIG. 36 is a perspective view of a seventh embodiment of a packaging box provided with an angled inner panel construction according to the present invention, with its top panels open.
Figure 37:
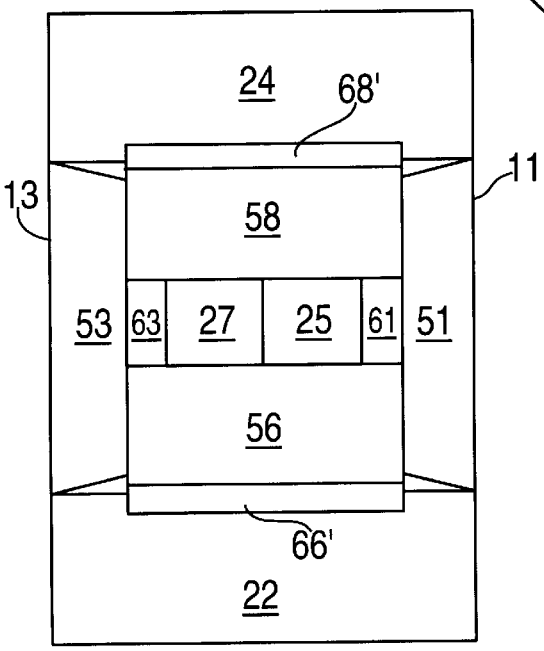
FIG. 37 is a top view of the packaging box of FIG. 36, with its top panels open.
Figure 38:
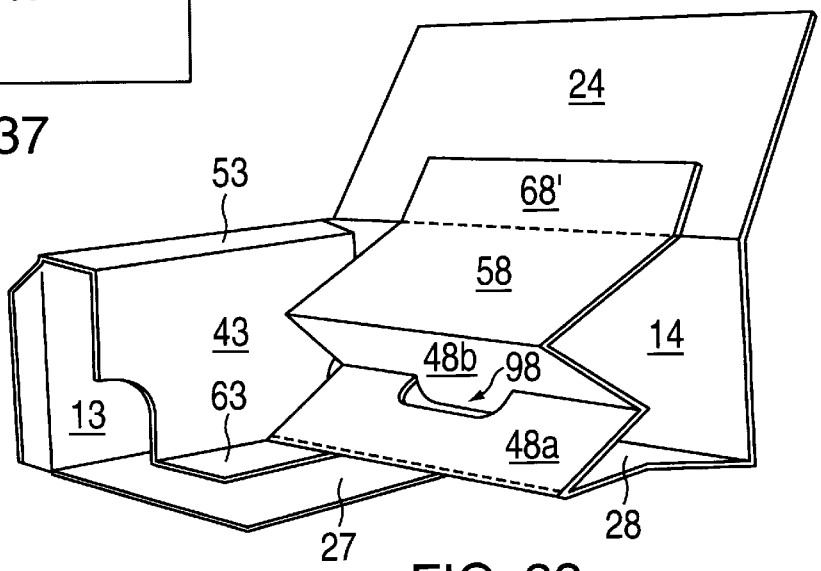
FIG. 38 is a perspective view of the packaging box of FIG. 36, with panels removed to show details of the inside of the box.

FIGS. 36 through 38 show a box 70 having outer side panels 11 to 14, top panels 22, 24, and bottom panels 25 to 28. Similar to the box 60, the box 70 has inner panels 46, 48 separated by bend lines into inner panel sections 46*a*, 46*b*, 48*a*, 48*b*, creating recesses for receiving items to protect the items during shipping. Similar to the box 60 shown in FIG. 33, the inner panels 46, 48 extend from the bottom panels 26, 28 and are positioned by distancing flaps 56, 58, which are connected by connecting flaps 66', 68' to top panels 22, 24.

Whereas the box 60 has inner side flaps 85, 87 and distancing flaps 75, 77, the box 70 has inner side panels 41, 43 and distancing flaps 51, 53, wherein the inner side panels 41, 43 are displaced from their adjacent outer side panels 11, 13 when the bottom panels 25, 27 of the box 70 are folded to their closed positions. The inner side panels 41, 43 are connected to the top edges of the adjacent outer side panels 11, 13 by the distancing flaps 51, 53, and the inner side panels 41, 43 are connected to the bottom panels 25, 27 by connecting flaps 61, 63. The inner side panels 41, 43, distancing flaps 51, 53, and connecting flaps 61, 63 are similar in construction and operation to those described in U.S. Pat. No. 5,769,309.

The box 70 has bracing tabs 96, 98 extending from the inner panel sections 46*b*, 48*b*. The bracing tabs 96, 98 may be formed, as shown, by being appropriately cut out of the inner panel sections 46*a*, 46*b*. In operation, the bracing tabs 96, 98 extend toward the bottom corners of the box 70, such that when the inner panels 46, 48 are displaced or move somewhat during packaging or shipping, the bracing tabs 96, 98 abut the corners or the adjacent panels 12, 26, 14, 28 to provide support for the inner panels 46, 48 and to limit their movement.

It will be understood that each of the elements described above, or two or more together, may also find a useful application in other types of constructions differing from the type described above.

While the present invention has been described and illustrated herein as embodied in certain specific constructions of a box, it is not limited to the details of these particular constructions, since various modifications and structural changes may be made without departing from the spirit of the present invention.

The present invention can be readily adapted for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A box comprising:

(a) a plurality of outer panels including (1) a plurality of outer side panels bounding an internal space; and (2) at least one closing panel connected to one of said outer side panels and foldable with respect to that outer side panel from an open position in which it is in substantially the same plane as that outer side panel to a closed position in which it is substantially orthogonal to that outer side panel; and (b) at least one inner panel associated with one of said at least one closing panels, wherein when that closing panel is in said open position, said at least one inner panel is in a plane substantially parallel to and adjacent to the plane of that closing panel, and when that closing panel is folded to said closed position, said at least one inner panel is moved toward the center of the box to a distanced position;

wherein when said at least one inner panel is in said distanced position, at least a portion of said at least one inner panel lies in a plane at an oblique angle with respect to both the plane of the closing panel with which it is associated and the plane of the outer side panel to which that closing panel is connected.

2. A box as recited in claim 1 comprising at least two of said inner panels.

3. A box as recited in claim 1 comprising at least four of said inner panels.

4. A box comprising:

(a) a plurality of outer panels including (1) a plurality of outer side panels bounding an internal space;

(2) a first top closing panel connected to a top edge of a first one of said outer side panels and foldable with respect to that first outer side panel from an open position in which it is in substantially the same plane as that first outer side panel to a closed position in which it is substantially orthogonal to that first outer side panel; and (3) a first bottom closing panel connected to a bottom edge of said first outer side panel and foldable with respect to that first outer side panel from an open position in which it is in substantially the same plane as that first outer side panel to a closed position in which it is substantially orthogonal to that first outer side panel; and (b) (1) a first inner panel associated with said first top closing panel, wherein when that first top closing panel is in said open position, said first inner panel is in a plane substantially parallel to and adjacent to the plane of that first top closing panel, and when that first top closing panel is folded to said closed position, said first inner panel is moved toward the center of the box to a distanced position;

wherein when said first inner panel is in said distanced position, at least a portion of said first inner panel lies in a plane at an oblique angle with respect to both the plane of the first top closing panel and the plane of the first outer side panel; and (2) a second inner panel associated with said first bottom closing panel, wherein when that first bottom closing panel is in said open position, said second inner panel is in a plane substantially parallel to and adjacent to the plane of that first bottom closing panel, and when that first bottom closing panel is folded to said closed position, said second inner panel is moved toward the center of the box to a distanced position;

wherein when said second inner panel is in said distanced position, at least a portion of said second inner panel lies in a plane at an oblique angle with respect to both the plane of the first bottom closing panel and the plane of the first outer side panel;

wherein when said first inner panel and said second inner panel are in their respective distanced positions, said first inner panel is oriented in different plane from said second inner panel.

5. A box as recited in claim 4, further comprising:

a second top closing panel connected to a top edge of a second one of said outer side panels and foldable with respect to that second outer side panel from an open position in which it is in substantially the same plane as that second outer side panel to a closed position in which it is substantially orthogonal to that second outer side panel; and a second bottom closing panel connected to a bottom edge of said second outer side panel and foldable with respect to that second outer side panel from an open position in which it is in substantially the same plane as that second outer side panel to a closed position in which it is substantially orthogonal to that second outer side panel;

a third inner panel associated with said second top closing panel, wherein when that second top closing panel is in said open position, said third inner panel is in a plane substantially parallel to and adjacent to the plane of that second top closing panel, and when that second top closing panel is folded to said closed position, said third inner panel is moved toward the center of the box to a distanced position, wherein when said third inner panel is in said distanced position, at least a portion of said third inner panel lies in a plane at an oblique angle with respect to both the plane of the second top closing panel and the plane of the second outer side panel; and a fourth inner panel associated with said second bottom closing panel, wherein when that second bottom closing panel is in said open position, said fourth inner panel is in a plane substantially parallel to and adjacent to the plane of that second bottom closing panel, and when that second bottom closing panel is folded to said closed position, said fourth inner panel is moved toward the center of the box to a distanced position, wherein when said fourth inner panel is in said distanced position, at least a portion of said fourth inner panel lies in a plane at an oblique angle with respect to both the plane of the second bottom closing panel and the plane of the second outer side panel; and wherein when said third inner panel and said fourth inner panel are in their respective distanced positions, said third inner panel is oriented in different plane from said fourth inner panel.

6. A box comprising:

(a) a plurality of outer panels including (1) a plurality of outer side panels bounding an internal space; and (2) at least one closing panel connected to one of said outer side panels and foldable with respect to that outer side panel from an open position in which it is in substantially the same plane as that outer side panel to a closed position in which it is substantially orthogonal to that outer side panel; and (b) at least one inner panel associated with one of said at least one closing panels, wherein when that closing panel is in said open position, said at least one inner panel is in a plane substantially parallel to and adjacent to the plane of that closing panel, and when that closing panel is folded to said closed position, said at least one inner panel is moved toward the center of the box to a distanced position;

wherein said at least one inner panel has at least one bend line dividing it into at least two inner panel sections;

wherein when said at least one inner panel is in said distanced position, at least a first one of said inner panel sections lies in a plane at an oblique angle with respect to both the plane of the closing panel with which it is associated and the plane of the outer side panel to which that closing panel is connected; and wherein when said at least one inner panel is in said distanced position, said first one of said inner panel sections is oriented in different plane from a second one of said inner panel sections.

7. A box as recited in claim 6, wherein when said at least one inner panel is in said distanced position, said first one of said inner panel sections and said second one of said inner panel sections form a recess at the bend line.

8. A box comprising:

(a) a plurality of outer panels including (1) a plurality of outer side panels bounding an internal space;

(2) a first closing panel connected to a first one of said outer side panels and foldable with respect to that first outer side panel from an open position in which it is in substantially the same plane as that first outer side panel to a closed position in which it is substantially orthogonal to that first outer side panel; and (3) a second closing panel connected to a second one of said outer side panels and foldable with respect to that second outer side panel from an open position in which it is in substantially the same plane as that second outer side panel to a closed position in which it is substantially orthogonal to that second outer side panel; and (b) (1) a first inner panel associated with said first closing panel, wherein when that first closing panel is in said open position, said first inner panel is in a plane substantially parallel to and adjacent to the plane of that first closing panel, and when that first closing panel is folded to said closed position, said first inner panel is moved toward the center of the box to a distanced position;

wherein said first inner panel has at least one bend line dividing it into at least two inner panel sections;

wherein when said first inner panel is in said distanced position, at least a first one of said inner panel sections of said first inner panel lies in a plane at an oblique angle with respect to both the plane of the first closing panel and the plane of the first outer side panel; and wherein when said first inner panel is in said distanced position, said first one of said inner panel sections of said first inner panel is oriented in different plane from a second one of said inner panel sections of said first inner panel; and (2) a second inner panel associated with said second closing panel, wherein when that second closing panel is in said open position, said second inner panel is in a plane substantially parallel to and adjacent to the plane of that second closing panel, and when that second closing panel is folded to said closed position, said second inner panel is moved toward the center of the box to a distanced position;

wherein said second inner panel has at least one bend line dividing it into at least two inner panel sections;

wherein when said second inner panel is in said distanced position, at least a first one of said inner panel sections of said second inner panel lies in a plane at an oblique angle with respect to both the plane of the second closing panel and the plane of the second outer side panel; and wherein when said second inner panel is in said distanced position, said first one of said inner panel sections of said second inner panel is oriented in different plane from a second one of said inner panel sections of said second inner panel.

9. A box as recited in claim 8, wherein when said first inner panel is in said distanced position, said first one of said inner panel sections of said first inner panel and said second one of said inner panel sections of said first inner panel form a first recess at the bend line of the first inner panel; and wherein when said second inner panel is in said distanced position, said first one of said inner panel sections of said second inner panel and said second one of said inner panel sections of said second inner panel form a second recess at the bend line of the second inner panel.

10. A box as recited in claim 9 wherein said first recess and said second recess face each other across the internal space of the box.

* * * * *